US005797072A

United States Patent [19]

Ehara et al.

[11] Patent Number: 5,797,072

[45] Date of Patent: Aug. 18, 1998

[54] APPARATUS AND METHOD FOR CONTACT CHARGING AN AMORPHOUS SILICON PHOTOCONDUCTOR VIA A MULIPOLAR MAGNETIC BODY HAVING A MAGNETIC BRUSH LAYER

[75] Inventors: Toshiyuki Ehara, Yokohama; Masaya Kawada, Nara, both of Japan

[73] Assignee: Canon Kabushiki Kaisha, Tokyo, Japan

[21] Appl. No.: 698,798

[22] Filed: Aug. 16, 1996

[30] Foreign Application Priority Data

Aug. 21, 1995 [JP] Japan ..... 7-211575

[51] Int. Cl.[6] ..... G03G 15/02

[52] U.S. Cl. ..... 399/174; 361/225; 399/175; 430/66

[58] Field of Search ..... 399/159, 174–176; 430/62, 66, 67; 361/225, 230

[56] References Cited

U.S. PATENT DOCUMENTS

| | | | |
|---|---|---|---|
| 4,451,547 | 5/1984 | Hirai et al. | 430/128 |
| 4,788,120 | 11/1988 | Shirai et al. | 430/66 |
| 5,146,280 | 9/1992 | Kisu | 399/176 |
| 5,236,798 | 8/1993 | Aoike et al. | 430/66 |
| 5,406,353 | 4/1995 | Asanae | 399/174 |
| 5,426,489 | 6/1995 | Haneda et al. | 399/175 |
| 5,561,021 | 10/1996 | Yamazaki et al. | 430/66 X |

FOREIGN PATENT DOCUMENTS

| | | |
|---|---|---|
| 54-83746 | 7/1979 | Japan . |
| 57-11556 | 1/1982 | Japan . |
| 57-158650 | 9/1982 | Japan . |
| 59-133569 | 7/1984 | Japan . |
| 60-67951 | 4/1985 | Japan . |
| 60-95551 | 5/1985 | Japan . |
| 60-35059 | 8/1985 | Japan . |
| 61-231561 | 10/1986 | Japan . |
| 62-168161 | 7/1987 | Japan . |
| 63-208878 | 8/1988 | Japan . |
| 64-34205 | 3/1989 | Japan . |

*Primary Examiner*—William J. Royer
*Attorney, Agent, or Firm*—Fitzpatrick, Cella, Harper & Scinto

[57] ABSTRACT

An image-forming apparatus is provided which has a photosensitive member having improved temperature characteristics and improved electric properties and an ozoneless charging system in combination, and employs neither a heater nor a cleaning roller. In the apparatus, a charging member having a cylindrical multipolar magnetic body of 500 G or stronger and a magnetic brush layer formed from a magnetic powder on the peripheral surface of the magnetic body is allowed to rub the surface of a charging object in a reverse direction at a movement speed ratio of not less than 110% to charge the charging object. The charging object is a photosensitive member having a photoconductive layer composed of non-single-crystal silicon. The photoconductive layer contains hydrogen at a content ranging from 10 to 30 atomic %, and Si—$H_2$/Si—H at a ratio ranging from 0.2 to 0.5, having density of state ranging from $1\times10^{14}$ $cm^{-3}$ to $1\times10^{16}$ $cm^{-3}$ and characteristic energy of the exponential tail ranging from 50 to 60 meV derived from subband-gap light absorption spectrum at a light-introducing portion, and having a surface resistivity ranging from $1\times10^{10}$ to $5\times10^{15}$ Ωcm. The magnetic powder has a resistivity ranging from $1\times10^{4}$ to $1\times10^{9}$ Ωcm, and particle diameters ranging from 10 to 50 μm.

10 Claims, 11 Drawing Sheets a : MOVING SPEED OF CHARGING MEMBER b : MOVING SPEED OF OBJECT TO BE CHARGED

ROTATION DIRECTION OF CHARGING MEMBER BEING POSITIVE

APPARATUS AND METHOD FOR CONTACT CHARGING AN AMORPHOUS SILICON PHOTOCONDUCTOR VIA A MULIPOLAR MAGNETIC BODY HAVING A MAGNETIC BRUSH LAYER

BACKGROUND OF THE INVENTION

1. Field of the Invention

The present invention relates to an image-forming apparatus and an image-forming method such as electronic copying machines and laser beam printers applying electrophotographic technique. More particularly, the present invention relates to an image-forming apparatus and an image-forming method employing a charging device for charging electrically an object to be charged (hereinafter referred to as "charging object") by bringing magnetic powder into contact with the charging object.

2. Related Background Art (1) Image-Forming Apparatus:

Image-forming apparatuses are widely used not only as a copying machine for copying an original document but also as a printer increasingly used for computers and word processors. Since such printers have come to be used for personal uses as well as for office uses, economical efficiency such as low cost and no maintenance-requirement is desired for the printers.

Moreover from the ecological standpoint, desired are saving of copying paper consumption, for example, by copying on both faces and on regenerated paper, saving of power consumption, and prevention of ozone emission not to cause adverse biological effects, in addition to the economical efficiency.

The conventional corona charger, which has predominantly been used, charges a counterposed object by ionizing the environmental atmosphere by application of a high voltage of about 5–10 kV to metal wires of about 50–100 μm. In the process of the electric charging, the wires also will be soiled by dust adsorption and needs periodical cleaning or replacement, and ozone is generated in a large amount by the corona discharge.

For energy saving, one problem is the structure of the heater for the photosensitive member. The conventional electrophotographic sensitive member, which has a high surface hardness for long life thereof, adsorbs ozone derivatives formed from the ozone generated by the charger in repeated use. The ozone derivatives will become wet in a high humidity conditions to cause lateral migration of surface charges on the photosensitive member. This surface charge migration causes image smearing to impair the image quality.

To prevent the smearing of the image, various methods have been proposed, including heating of the photosensitive member, rubbing of the photosensitive member surface with a brush formed by a magnet roller and a magnetic toner to remove the ozone derivative, rubbing of the photosensitive member with an elastic roller to remove the corona derivatives, and so forth.

The rubbing of the photosensitive member surface is employed for an amorphous silicon photosensitive member having an extremely high hardness, but the rubbing device makes difficult miniaturization of the apparatus and reduction of the cost. On the other hand, the incessant heating of the photosensitive member results in increase of the power consumption. The heater output, which is usually about 15–80 W and is not so large seemingly, accounts for as much as 5–15% of the total power consumption of the image forming apparatus, when the apparatus is kept under 24-hour continuous electricity application as usual.

Since the aforementioned ozone which causes the image smearing can impair the health of humans and other living things, the air discharged from the apparatus is conventionally passed through an ozone-removal filter to decompose and inactivate the ozone. In particular, the image-forming apparatus for personal use should emit the ozone as little as possible.

Therefore, an economical method is demanded for suppressing effectively the generation of ozone on charging of the photosensitive member.

(2) Charging Device:

Various charging devices are proposed to solve the above problems.

The contact type charging method disclosed in Japanese Patent Application Laid-Open No. 63-208878 charges a surface of a charging object to a desired potential by contact of a voltage-applied charging member, and has advantages as follows in comparison with widely used corona chargers. Firstly, the required voltage is lower for obtaining a desired potential of a charging object. Secondly, no or little ozone is generated in the charging process, obviating the necessity of ozone-removal filter, simplifying the evacuation system of the apparatus, and making the apparatus maintenance-free. Thirdly, the conventionally conducted nonstop whole-day heating for dehumidification is not necessary for preventing image smearing caused by decrease of the surface resistivity of an image-holding member brought about by ozone or an ozone derivative, and thereby the power consumption including the heating during night time can be greatly decreased. Therefore, the contact charging method is attracting attention, and is practicalized as the means for charging an image-holding member such as a photosensitive member and dielectric member for image-forming apparatuses (copying machines, and laser beam printers), an electrostatic recording apparatus or the like in place of the corona charger.

Such a contact type charging means typically charges a charging object by bringing it into contact with a fixed charging member like a blade or a sheet to apply a bias voltage.

FIG. 1 shows an example of a contact type charging means. In the drawing, the contact type charging means charges a photosensitive drum 101 which is a drum type electrophotographic photosensitive member driven to rotate clockwise as shown by the arrow mark A at a prescribed drum face movement speed (hereinafter referred to as a "process speed"), and a contact type charging member 102 which has an electrode 102-1 and a resistance layer 102-2 formed on the electrode surface. The electrode 102-1 is usually made of a metal such as aluminum, an aluminum alloy, brass, copper, iron, and stainless steel, or an insulating material such as a resin and a ceramic having been treated for electroconductivity, for example, metal coating, or electroconductive paint coating. The resistance layer 102-2 is usually made of a resin such as polypropylene and polyethylene or an elastomer such as silicone rubbers, and urethane rubbers containing an electroconductive filler such as titanium oxide, powdery carbon, and powdery metal. The resistance layer 102-2 has a resistivity ranging from $1\times10^3$ to $1\times10^{12}$ Ωcm as measured by a MΩ tester manufactured by HIOKI Co. at an applied voltage of 250 V to 1 kV. A voltage application source 103 applies to the charging member 102 a superposed voltage (Vac+Vdc) composed of an AC voltage (Vac) having a peak-to-peak voltage (Vpp) of more than twice that of the charge initiation voltage and DC voltage (Vdc). Thereby the rotating photosensitive drum 101 is electrically charged uniformly at the peripheral surface.

Then a light beam 105 like a laser light beam having been intensity-modulated in accordance with image signals is allowed to scan the photosensitive drum to form a latent image on the photosensitive drum. This latent image is developed by a developing agent transferred from a developing sleeve 106 to the photosensitive drum 101. The developed image is then transferred to transfer-receiving medium 107 such as a paper sheet by a transfer roller 108. The developing agent remaining untransferred on the photosensitive member is removed by a cleaning blade 109 from the photosensitive drum 101. The transferred image on the transfer-receiving medium 107 is fixed by a fixing device not shown in the drawing, and then discharged from the apparatus.

In this system, however, owing to direct contact of the charging member with the photosensitive drum, the contact type charging member will wear out inevitably, and should be replaced periodically with a new one. Since the amorphous silicon photosensitive member which has come to be widely employed for image-forming apparatuses has a semi-permanent life, the replacement of the contact type charging member is against the omission of maintenance of the image-forming apparatus. Therefore, the improvement of the contact type charging member is strongly desired.

To meet the desire, contact type charging means has been improved in various ways. For instance, a system was disclosed in which a magnetic brush constituted of a magnetic body and a powdery (or particulate) magnetic material is brought into contact with a photosensitive member to charge the photosensitive member as shown in Japanese Patent Application Laid-Open No. 59-133569.

FIG. 2A shows an example thereof. In FIG. 2A, a contact type charging means charges a photosensitive drum 101, an image-holding member, which is a drum type electrophotographic photosensitive member driven to rotate clockwise as shown by the arrow mark A at a prescribed process speed, and a charging member 202 which has a multipolar magnetic body 202-2 and a magnetic brush layer 202-1 formed thereon from a magnetic powder. FIG. 2B is a schematic side view of the magnetic brush. The multipolar magnetic body 202-2 has a cylindrical constitution of a magnet roller made usually of a magnetic material such as a ferrite magnet and a rubber magnet. The magnet brush layer 202-1 is usually formed from powdery magnetic iron oxide (ferrite), powdery magnetite, or a known magnetic toner material. The electric resistance of the charging member is selected suitably depending on the environmental conditions, the charging efficiency, and the dielectric strength of the surface layer of the photosensitive member. The gap between the photosensitive member 101 and the contact type charging member 202 should be fixed at a certain distance to stabilize the nip of the magnetic brush layer 202-1. The distance is preferably in the range of from 50 to 2000 μm, more preferably from 100 to 1000 μm. A voltage source 203 applies DC voltage Vdc to the multipolar magnetic body 202-2 and the magnetic brush layer 202-1 to charge uniformly the peripheral surface of the rotating photosensitive drum 101.

Then a light beam 105 like a laser light beam having been intensity-modulated in accordance with image signals is allowed to scan the photosensitive drum to form a latent image on the photosensitive drum. This latent image is developed by a developing agent applied onto a developing sleeve 106. The developed image is then transferred to transfer-receiving medium 107 by a transfer roller 108. The developing agent remaining untransferred on the photosensitive member is removed by a cleaning blade 109 from the photosensitive drum 101. The transferred image on the transfer-receiving medium 107 is fixed by a fixing device not shown in the drawing, and then discharged from the apparatus.

This system improves the contacting properties, and friction characteristics between the photosensitive member and the contact type charging member, and reduces remarkably the mechanical abrasion and other deterioration thereof.

(3) Non-single-crystal Silicon Type Photosensitive Member:

In electrophotography, a photoconductive material for constituting a photosensitive member is required to have characteristics of high sensitivity, high SN ratio [photoelectric current (Ip)/dark current (Id)], absorption spectrum suitable for spectrum characteristics of the irradiating electromagnetic wave, quick light responsiveness, desirable dark resistance, harmlessness to human bodies during use, and so forth. In particular, a photosensitive member incorporated into an image-forming apparatus used in offices as a business machine is required not to cause public nuisance during use.

An excellent material having the above characteristics is hydrogenated amorphous silicon (hereinafter referred to as "a-Si:H"), a non-single-crystal silicon type material. For example, Japanese Patent Publication No. 60-35059 describes application thereof as a photosensitive member for an image-forming apparatus.

The photosensitive member for an image-forming apparatus employing the a-Si:H is prepared by heating an electroconductive support to a temperature of 50°–400° C. and forming thereon a photoconductive layer composed of a-Si by a film-forming method such as vacuum vapor deposition, sputtering, ion-plating, thermal CVD, photoassisted CVD, and plasma CVD. Of these methods, practically and suitably employed is plasma CVD in which a source gas is decomposed by glow discharge by DC, high frequency, or microwave, and an a-Si deposition film is formed on the support.

As another method, Japanese Patent Application Laid-Open No. 54-83746 discloses a photosensitive member for an image-forming apparatus constituted of an electroconductive support and a photoconductive layer composed of amorphous silicon containing a halogen atom as the constituting element (hereinafter referred to as "a-Si:X") which is a kind of non-single-crystal silicon material. According to this Japanese Patent Application Laid-Open No. 54-83746, a-Si which contains halogen atoms in a content of 1 to 40 atomic % gives a photoconductive layer having high heat resistance, excellent electrical and optical properties for a photoconductive layer of a photosensitive member for an image-forming apparatus.

Japanese Patent Application Laid-Open No. 57-11556 discloses formation of a surface layer constituted of a nonphotoconductive amorphous material containing silicon atoms and carbon atoms on a photoconductive layer constituted of an amorphous material mainly composed of silicon atoms, thereby improving electrical, optical, and photoconductive characteristics such as dark resistivity, photosensitivity, and photoresponsiveness; environmental characteristics such as humidity resistance; and economical stability.

Japanese Patent Application Laid-Open No. 60-67951 discloses lamination of a light-transmissive insulation overcoat layer containing amorphous silicon, carbon, oxygen, and fluorine for a photosensitive member.

Japanese Patent Application Laid-Open No. 62-168161 discloses a formation of a surface layer from an amorphous material containing silicon atoms, carbon atoms, and 41–70 atomic % of hydrogen atoms as the constituting elements.

Japanese Patent Application Laid-Open No. 57-158650 discloses a photosensitive member of high sensitivity and high resistivity for an image-forming apparatus formed by employing, as a photoconductive layer, a-Si:H containing 10–40 atomic % of hydrogen, and having a ratio of IR absorption coefficient of 2100 $cm^{-1}$ to that at 2000 $cm^{-1}$ in the range of from 0.2 to 1.7.

Japanese Patent Application Laid-Open No. 60-95551 discloses improvement of quality of the image formed by amorphous silicon photosensitive member in which a temperature of the surface and the vicinity thereof of the photosensitive member is maintained at 30° to 40° C. throughout the image formation process of electric charging, light exposure, development, and image transfer to prevent the surface resistivity drop caused by adsorption of water on the surface of the photosensitive member and the resulting image smearing.

These techniques have improved the electric, optical, and photoconductive characteristics and the environmental characteristics of the image-forming photosensitive member, thereby improving the image quality.

(4) Heater to Counteract Adverse Environmental Effects:

To prevent the aforementioned image smearing by humidity on the photosensitive member, a heater is generally provided inside of the photosensitive member. Generally, a planar or bar-shaped electric heater is equipped inside a cylindrical photosensitive member.

Japanese Utility Model Publication No. 1-34205 discloses a photosensitive member with a heater to prevent image smearing. However, the incessant heating increases the power consumption as mentioned above.

On the other hand, the above-described amorphous silicon photosensitive member involves the problems below when used as an image-forming apparatus. (The process for production of the amorphous silicon photosensitive member is described later in detail.)

To meet the requirement for miniaturization of business machines, the image-forming apparatus can be miniaturized by employing the aforementioned voltage application type charging device using magnetic particles as a brush in comparison with the conventional corona charging device. However, even with the charging device employing the magnetic particles as a brush which generates no or little ozone, the rubbing with a cleaner such as a magnetic brush and/or the heating with a heater are necessary for the amorphous silicon photosensitive member having a much longer life than other photosensitive members. Therefore, the image smearing cannot readily be avoided for a long term continuously without the rubbing with a cleaner like a magnetic brush. On the other hand, further miniaturization cannot be attained provided that the magnetic brush is used for rubbing for cleaning.

Apart from the above problem of the image smearing, if the characteristics of the photosensitive member depend largely on temperature, the temperature of the photosensitive member needs to be controlled by a heater, which renders it difficult to decrease the diameter of the photosensitive member for miniaturization of the apparatus.

Accordingly, in development of an image-forming apparatus and a process for forming an electrophotographic image, the electrophotographic properties of the photosensitive member for an imageforming apparatus, the charging device, and the imageforming apparatus should be improved in consideration of the above problems.

SUMMARY OF THE INVENTION

An object of the present invention is to provide an image-forming apparatus which employs a novel electric charging system without electric discharge and is desirable ecologically, where a charging object used has less temperature-dependent functional properties, a magnetic powder is brought into contact with the charging object for the electric charging, no heating source is used or energy can be saved, and high-quality images can be provided for a long term.

Another object of the present invention is to provide a method for image formation employing the above image-forming apparatus.

The image-forming apparatus of the present invention forms an electrostatic latent image on a surface of a charging object by applying a voltage to a charging member comprising a cylindrical multipolar magnetic body and a brush layer formed from a magnetic powder on the peripheral surface thereof, and charging the surface of the charging object by rubbing the surface thereof with the surface of the brush layer by movement in reverse direction, and forming a latent image on the surface of the charging object, wherein the charging object is a photosensitive member having a photoconductive layer comprising a non-single-crystal material containing silicon atoms as a matrix and hydrogen and/or halogen atoms on an electroconductive support; the photoconductive layer contains hydrogen at a content ranging from 10 to 30 atomic %, and Si—$H_2$/Si—H at a ratio ranging from 0.2 to 0.5, having density of state ranging from $1\times10^{14}$ $cm^{-3}$ to $1\times10^{x}cm^{-3}$ and characteristic energy of the exponential tail ranging from 50 to 60 meV derived from subband-gap light absorption spectrum at least at a light introducing portion, and having a surface resistivity ranging from $1\times10^{10}$ to $5\times10^{15}$ Ωcm; the multipolar magnetic body has a magnetic force of not lower than 500 G; the magnetic powder has a resistivity ranging from $1\times10^{4}$ to $1\times10^{9}$ Ωcm, and particle diameters ranging from 10 to 50 μm; the time of contact of a point on the charging object with the brush layer is not shorter than 10 msec; and the charging member and the charging object move at a relative moving speed in relation of (a-b)/a×100% of not less than 110% where a is the moving speed of the charging object, b is the moving speed of the charging member, and the rotation direction of the charging object is taken to be positive. The apparatus may have an optical charge-removing means optionally for removing the electric charge from the charging object.

The image-forming method of the present invention forms an electrostatic latent image on a surface of a charging object by applying a voltage to a charging member comprising a cylindrical multipolar magnetic body and a brush layer formed from a magnetic powder on the peripheral surface thereof, and charging the surface of the charging object by rubbing the surface thereof with the surface of the brush layer by movement in reverse direction, and irradiating imagewise the surface of the charging object to form a latent image thereon, wherein the charging object is a photosensitive member having a photoconductive layer comprising a non-single-crystal material containing silicon atoms as a matrix and hydrogen and/or halogen atoms on an electroconductive support; the photoconductive layer contains hydrogen-at a content ranging from 10 to 30 atomic %, and Si—$H_2$/Si—H at a ratio ranging from 0.2 to 0.5, having density of state ranging from $1\times10^{14}$ $cm^{-3}$ to $1\times10^{x}cm^{-3}$ and characteristic energy of the exponential tail ranging from 50 to 60 meV derived from subband-gap light absorption spectrum at least at a light introducing portion, and has a surface resistivity ranging from $1\times10^{10}$ to $5\times10^{15}$ Ωcm; the multipolar magnetic body has a magnetic force of not lower than 500 G; the magnetic powder has a resistivity ranging from $1\times10^{4}$ to $1\times10^{9}$ Ωcm, and particle diameters ranging from 10 to 50 μm; the time of contact of a point on the charging object with the brush layer is not shorter than 10 msec; and the charging member and the charging object move at a relative moving speed in relation of (a-b)/a×100% of not less than 110% where a is the moving speed of the charging object, b is the moving speed of the charging member, and the rotation direction of the charging object is taken to be positive.

The charging object employed in the present invention is a photosensitive member which is comprised of an electroconductive support and a light-receiving layer comprising a photoconductive layer constituted of a non-single-crystal material containing silicon atoms as a matrix and hydrogen and/or halogen atoms and is photoconductive, and a surface layer having a function of retaining charges, wherein the photoconductive layer contains hydrogen at a content ranging from 10 to 30 atomic %, having density of state ranging from $1\times10^{14}$ to $1\times10^{16}$ $cm^{-3}$ and characteristic energy of the exponential tail ranging from 50 to 60 meV, derived from subband-gap light absorption spectrum at least at a light-introducing portion, thereby the photomemory inherent to the amorphous silicon photosensitive member being reduced, and the temperature dependence of electric properties being reduced to enabling omission of temperature control of the photosensitive member. Further, the resistivity of the surface layer has $1\times10^{10}$ to $1\times10^{15}$ Ωcm, the multipolar magnetic body has a magnetic force of not lower than 500 G; the magnetic powder has a resistivity ranging from $1\times10^{4}$ to $1\times10^{9}$ Ωcm, and particle diameters ranging from 10 to 50 μm; the time of contact of a point on the charging object with the charging member is not shorter than 10 msec; thereby, a high charging efficiency being achieved and sufficient levelling effect being attained, which enables omission of the charge-removing light exposure or enables sufficient charging even with strong charge-removing light exposure in combination of the above photoconductive layer, and the photomemory is reduced without lowering of the chargeability.

The term "leveling effect" mentioned above means an effect of leveling of the states of the exposed and non-exposed portions in the preceding step. More specifically, it means the effect of bringing the state of the exposed portion close to the state of the non-exposed portion by sufficient charging to expel remaining photocarriers in the exposed portion, or the effect of removing the difference in the states by generating a sufficient amount of photocarriers by intense irradiation of charge-removing light to bring once the states of the exposed and non-exposed portions close to each other, and then expelling the remaining carrier by sufficient charging.

Furthermore in the present invention, rubbing with a cleaner such as a magnetic brush for prevention of high-humidity image smearing can be omitted by rotating the charging member in a surface movement direction reverse to the rotational movement of the charging object at the opposing surface, controlling the ratio of the rotation speed of the charging member to that of the charging object to be not lower than 0.1, and employing a magnetic powder of particle diameter ranging from 10 to 50 μm.

DETAILED DESCRIPTION OF THE PREFERRED EMBODIMENTS

The present invention is explained below in detail by reference to drawings.

[Charging Member]

Figure 3A:
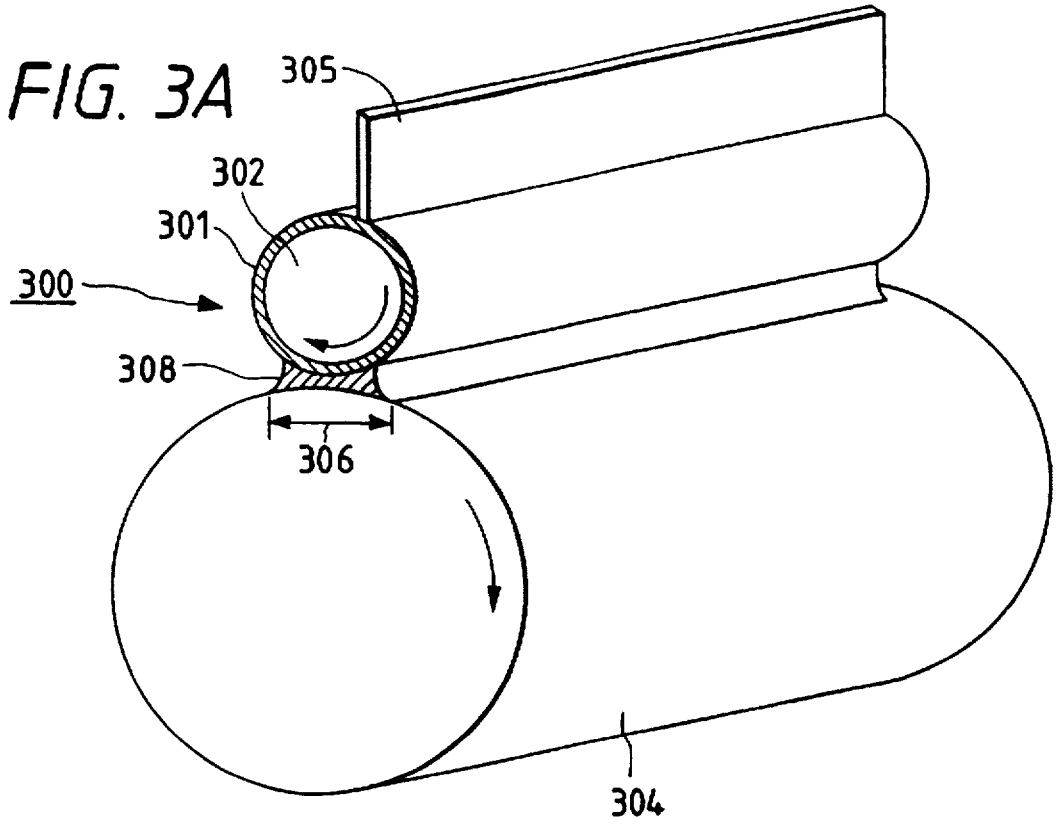
FIG. 3A is a schematic perspective view and FIG. 3B is a schematic lateral view of a preferred example of assemblage of a charging member, a charging device, and an image-forming device of the present invention.
Figure 3B:
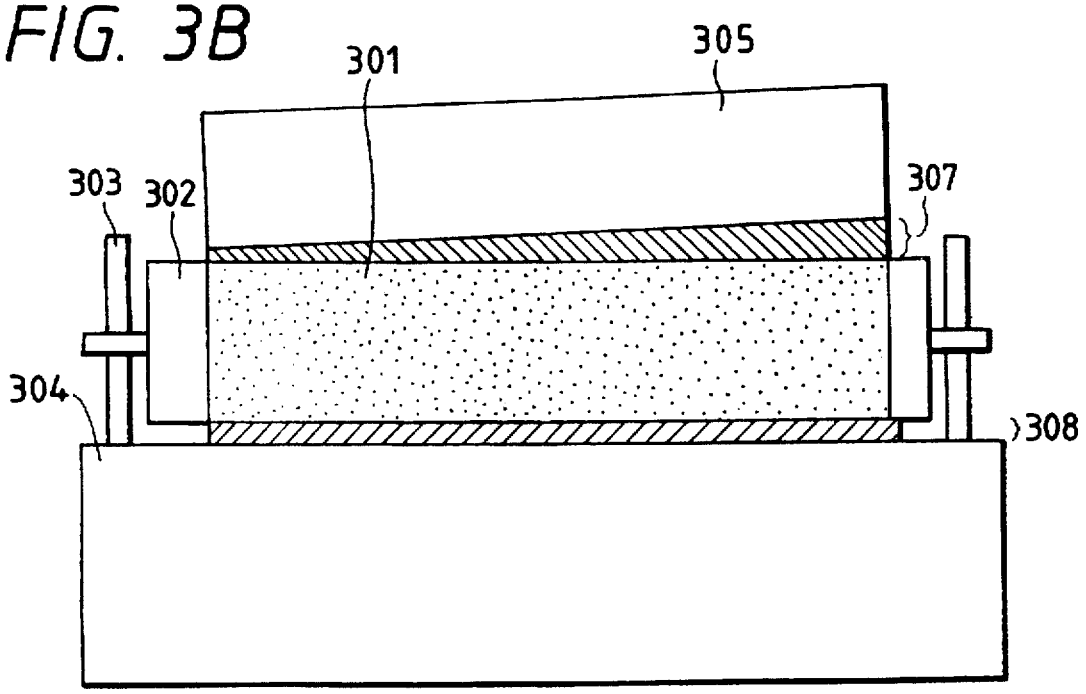

FIGS. 3A and 3B show schematically a charging member and a charging object of the present invention. In FIGS. 3A and 3B, the contact type charging member 300 comprises a magnetic brush layer 301 and a multipolar magnetic body 302. A spacer 303 controls a gap 308 between the contact type charging member 300 and a charging object 304. The numeral 304 indicates a charging object such as a cylindrical photosensitive member. A plate-shaped member 305 controls the thickness of a magnetic brush layer 307. The numeral 306 indicates a nip breadth.

The multipolar magnetic body 302 of the contact type charging member 300 is formed in a cylindrical shape from a magnetic body capable of constituting a multipolar magnetic body, the material therefor including metals such as ferrite, and plastic magnets. The preferred magnetic line density depends on the process speed, the electric field caused by voltage application, the dielectric constant and the surface properties of the charging object, and other factors, and is preferably not lower than 500 Gauss (G), more preferably not lower than 1000 G at the position of the magnet pole at a distance of 1 mm from the surface of the magnetic body 302.

The nip 306 formed by deformation of the magnetic brush layer 301 on the charging object affects the charging efficiency. Therefore, the potential of the charging object 304 can be controlled by stable control of the nip. The nip can be controlled by various manners. For example, it can be controlled by change of the thickness 307 of the magnetic brush layer as shown in FIG. 3B, or by change of the gap 308 between the charging member 300 and the charging object 304. The gap 308 is preferably in the range of from 50 to 2000 μm, more preferably from 100 to 1000 μm.

On the peripheral surface of the multipolar magnetic body 302, the magnetic brush layer 301 is formed from a magnetic powder attracted by the magnetic force. The magnetic powder includes generally powdery ferrite, powdery magnetite, and known carriers of magnetic toners. The particle diameter of the magnetic powder generally ranges from 1 to 100 μm, preferably not larger than 50 μm. For improving the fluidity, charging carriers having different particle diameter may be mixed within the above particle diameter range.

If fine defects appear on the surface of the charging object or insulation of the charging object is broken partially by leakage, electric current can flow locally and concentratedly in a major axis direction of the charging object. In such a state, the brush layer 301 having excessively low resistivity is not capable of charging sufficiently the entire region of the charging object in the major axis direction, whereas the brush layer 301 having excessively high resistivity exhibits lower charging efficiency. Thus, the resistivity of the brush layer 301 between the outside periphery and the inside periphery is preferably in the range of from $1\times10^3$ to $1\times10^{12}$ Ωcm, more preferably from $1\times10^4$ to $1\times10^9$ Ωcm.

The charging object 304 such as a photosensitive member is explained later.

In the present invention, the rubbing with a cleaner employing a magnetic brush or the like for prevention of high-humidity image smearing can be omitted by using combinedly the aforementioned contact type charging member employing the magnetic brush and the photosensitive member explained later, and rotating the charging member and the charging object in the same direction (i.e., the opposing surface moving in the reverse direction) at the peripheral surface movement speed at the ratio of not less than 0.1. Further, a high charging efficiency and sufficient leveling effect can be obtained by adjusting the contact time of a point on the photosensitive member with the charging member to not less than 10 msec. Thus, charge-removing light exposure can be omitted by combination with the photoconductive layer explained later, or even after strong light exposure for charge removal, sufficient charge can be obtained. Thereby, the photomemory is reduced or eliminated without lowering chargeability, which enables miniaturization of the image-forming apparatus and construction of an image-forming system giving improved image quality without an ecological problem.

[Photosensitive Member]

As a means for solving the above problems, it has been found by the inventors of the present invention that a combination of the aforementioned charging member and a photosensitive member of a specified constitution achieves decreased photomemory, low temperature dependency, and excellent surface durability, and enables formation of excellent images stably for a long term.

[Amorphous Silicon Type Photosensitive Member (a-Si)]

An amorphous silicon photosensitive member is explained below which is a type of photosensitive member suitable in the present invention.

After comprehensive investigation on the dependency of the chargeability and the photomemory on the localization state distribution in the band gap in consideration of the behavior of the carriers in the photoconductive layer of an amorphous silicon photosensitive member, it was found by the inventors of the present invention that the above object can be achieved by controlling the density of state in a specified energy range to be within a certain limit. More specifically, a photosensitive member having a photosensitive layer constituted of a non-single-crystal material containing silicon atoms as a matrix and hydrogen atoms and/or halogen atoms, and designed to have a specified layer structure, exhibits excellent characteristics practically in every respect, in particular as a photosensitive member for an image-forming apparatus, in comparison with conventional photosensitive members.

The photosensitive member for an image-forming apparatus of the present invention comprises an electroconductive support and a photosensitive layer which comprises a photoconductive layer composed of a non-single-crystal material having silicon atoms as a matrix. The photoconductive layer contains hydrogen at a content of from 10 to 30 atomic %, and has, at least at a light-introducing portion, the density of state ranging from $1\times10^{14}$ to $1\times10^{16}$ $cm^{-3}$ and the characteristic energy ranging from 50 to 60 meV at the exponential tail derived from light absorption spectrum.

The photosensitive member for an image-forming apparatus of the present invention having the aforementioned constitution solves all the problems mentioned above, and is excellent in electrical, optical and photoconductive properties, image quality, durability, and resistance to environmental conditions.

Generally, in the band gap of a-Si:H, there are a tail level caused by structural disorder of Si—Si bonds, and a deep level caused by a structural defect such as a dangling bond of Si. These levels function as centers for capturing electrons and positive holes, and for rebonding to impair the characteristics of an element.

The state of the localization level in the band gap can generally be measured by deep level spectrometry, isothermal volume transient spectrometry, opto-thermal deflection spectrometry, constant photocurrent method, and so forth. Of these measurement methods, constant photocurrent method (hereinafter referred to as "CPM") is useful as a simplified method for measuring the sub-gap light absorption spectrum caused by a localization level of a-Si:H.

The inventors of the present invention studied correlation between characteristics of the photosensitive member and density of state (hereinafter referred to as "DOS") and characteristic energy of the exponential tail (Urbuck tail) (hereinafter referred to as "Eu") derived from light absorption spectrum measured by CPM under various conditions. As the results, the inventors found that the Eu and the DOS are the important factors for the temperature characteristics and the photomemory of the a-Si photosensitive member.

The present invention has been accomplished based on the above findings.

When the photosensitive member is heated by a drum heater or the like, the chargeability of the photosensitive member becomes lower. This is caused by canceling of the surface charges by thermally excited carriers which have been driven to the surface by the charging electric field through capturing to and releasing from the localization level of the band tails and the deep localization level of the band gaps. While the photosensitive member is passing through the charging device, the thermally excited carriers on the surface affect little the chargeability of the photosensitive member. However, after the photosensitive member passed the charging device position, the carriers captured to the deep levels will reach the surface, and cancel the surface charge, which is observed as the temperature characteristics of the photosensitive member. Further, thermally excited carriers formed after the passage through the charging device also come to cancel the surface charge to lower the chargeability. Therefore, to improve the temperature characteristics of the photosensitive member, the formation of the thermally excited carriers should be prevented in the temperature range in which the photosensitive member is used, and the mobility of the thermally excited carrier should be accelerated.

The photomemory is caused by the remaining photocarriers which have been formed by blank exposure or image light exposure and are captured in the localization level in the band gap to remain in the photoconductive layer. In other words, the photocarriers remaining after a copying cycle are released by an electric field for charging the surface in the next or a later charging step to lower the potential of the light-irradiated portion, to cause irregularity of the image density. Therefore, the mobility of the photocarrier should be improved so as to reach the surface within the one copying cycle.

According to the present invention, Eu and DOS in a specified energy range are controlled to retard the formation of thermally excited carriers, and ratio of the thermally excited carriers and photocarriers captured by the localization level is decreased, whereby mobility of the above carriers (hereinafter referred to as "charge carriers") is remarkably improved, and occurrence of the photomemory is retarded. Consequently, the photosensitive member is stabilized against the variation of the environmental conditions, and produces stably high-quality images with sufficient half tone and high resolution.

[Charging object]

The charging object of the present invention is explained below in detail by reference to the drawings.

FIGS. 4A to 4D are schematic sectional views showing examples of the photosensitive member as the charging object for an image-forming apparatus of the present invention.

Figure 4A:
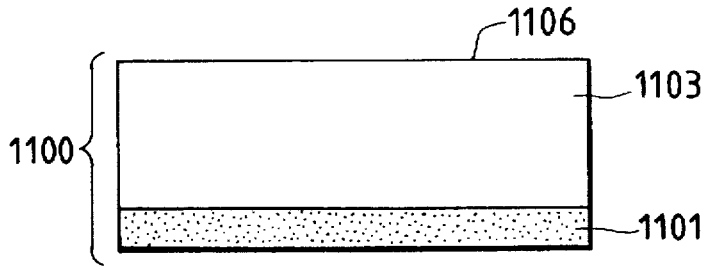
FIGS. 4A to 4D illustrate schematically examples of the layer constitution of photosensitive member for an image-forming apparatus of the present invention.

The photosensitive member 1100 shown in FIG. 4A for an image-forming apparatus is constituted of a support 1101 and a photoconductive layer 1103 laminated on the support. The photoconductive layer 1103 is composed of hydrogenated and/or halogenated amorphous silicon [a-Si(H,X)] as a non-single-crystal silicon type material, and has photoconductivity.

Figure 4B:
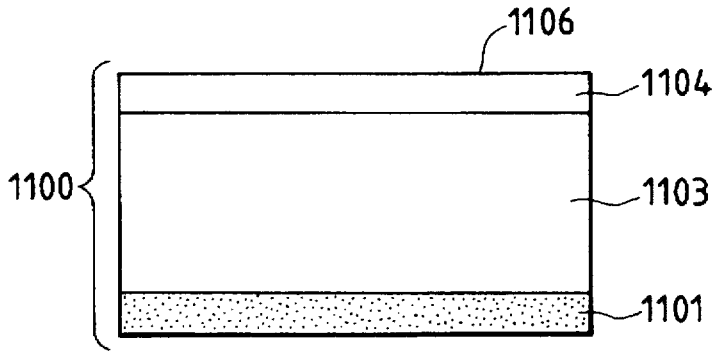

The photosensitive member 1100 shown in FIG. 4B for an image-forming apparatus is constituted of a support 1101, a photoconductive layer 1103, and a surface layer 1104 laminated successively on the support. The photoconductive layer 1103 is composed of a-Si(H,X) and has photoconductivity. The surface layer 1104 is of an amorphous silicon type and may contain carbon atoms and/or other atoms if necessary.

Figure 4C:
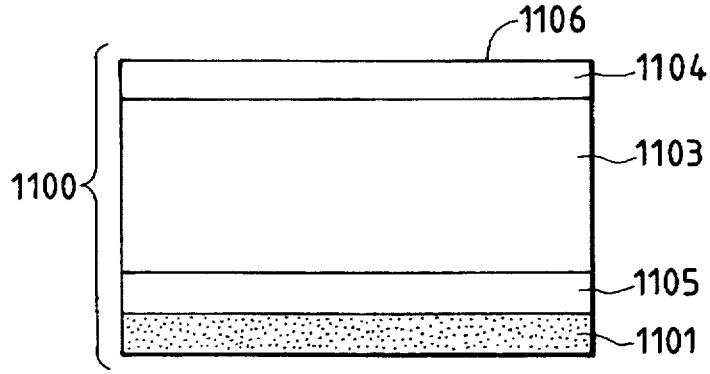

The photosensitive member 1100 shown in FIG. 4C for an image-forming apparatus is constituted of a support 1101, a photoconductive layer 1103 composed of a-Si(H,X) having photoconductivity, a surface layer 1104 such as an amorphous silicon type surface layer, a charge injection-preventing layer 1105 such as an amorphous silicon type charge injection-preventing layer composed of non-single-crystal type material containing any of atoms of Group 13 (or IIIb) and Group 15 (or Vb) of Periodic Table, oxygen, and carbon as necessary.

Figure 4D:
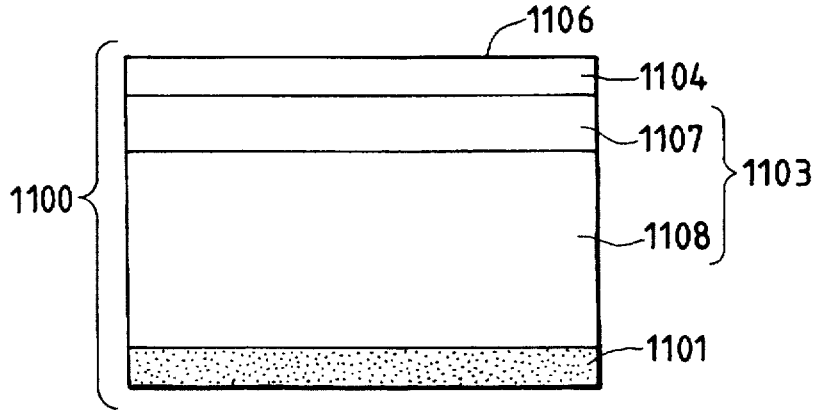

The photosensitive member 1100 shown in FIG. 4D for an image-forming apparatus is constituted of a support 1101; a charge-generating layer 1107 composed of a-Si(H,X) and a charge-transporting layer 1108 constituting a photoconductive layer 1103; and a surface layer 1104 such as an amorphous silicon type surface layer.

In FIGS. 4A to 4D, numeral 1106 indicates the surface of the photosensitive member 1100.

[Support]

The support employed in the present invention may be electroconductive or insulating. The material for the electroconductive support includes metals such as Al, Cr, Mo, Au, In, Nb, Te, V, Ti, Pt, Pd, and Fe, and alloys thereof such as stainless steel. The support may be an insulating support which is treated for electroconductivity on at least one surface on which the photoconductive layer is to be formed. The material for the insulating support includes films or sheets of synthetic resin such as polyester resins, polyethylene resins, polycarbonate resins, cellulose acetate resins, polypropylene resins, polyvinyl chloride resins, polystyrene resins, and polyamide resins.

The support 1101 employed in the present invention may be in a shape of a cylinder, or a flat endless belt having a smooth surface or a rough surface. The thickness of the support may be designed to be suitable for forming a desired photosensitive member 1100 for an image-forming apparatus. When the photosensitive member 1100 for the image-forming apparatus is required to be flexible, the support may be as thin as possible provided that the support is capable of performing the function of supporting. However, the support 1101 has usually a thickness of not less than 10 μm in view of mechanical strength in production and handling.

In particular, when coherent light such as a laser beam is employed for image recording, a surface of the support 1101 may be roughened to prevent image defects caused by interference fringes appearing in visible images, provided that the charge carriers are not decreased practically. The roughening of the surface of the support 1101 can be conducted by a known method such as described in Japanese Patent Application Laid-Open Nos. 60-168156, 60-178457, and 60-225854, and so forth.

The image defects caused by the interference fringes with coherent light such as a laser beam can also be prevented effectively by forming spherical concaves on the surface of the support 1101 so long as the charge carriers are substantially not decreased. More specifically, the surface of the support 1101 is roughened by spherical concaves finer than the dimension of the image resolution required to the photosensitive member 1100. The roughness by fine spherical concaves on the surface of the support 1101 can be produced, for example, by a known method such as described in Japanese Patent Application Laid-Open No. 61-231561.

In still another method, the image defects caused by the interference fringes with coherent light like a laser beam can be prevented by providing an interference-preventing layer or region such as a light-absorption layer in or underneath the photoconductive layer 1103.

|Photoconductive Layer|

The photoconductive layer 1103 can be formed on the support 1101, if necessary with interposition of a subbing layer (not shown in the drawings) for achieving the performance effectively, by a vacuum deposition film-forming method under selected film-forming parameter conditions to obtain desired layer properties. The thin film-forming method includes glow discharge (AC discharge CVD such as low frequency CVD, high frequency CVD, and microwave CVD, and DC discharge CVD), sputtering, vacuum vapor deposition, ion-plating, photo-assisted CVD, thermal CVD, and other thin film deposition methods. The thin film-forming method is selected in consideration of the production conditions, required capital investment, production scale, the required properties of the produced image-forming photosensitive member. Of these methods, the glow discharge method, especially high frequency glow discharge employing RF band or VHF band is suitable in view of the ease of control of the production conditions of the image-forming photosensitive member to have desired properties.

In the glow discharge for formation of the photosensitive layer 1103, in principle, an Si source gas for supplying silicon atoms (Si), an H source gas for supplying hydrogen atoms (H) and/or an X source gas for supplying halogen atoms (X) are introduced in a suitable gas state into an evacuated reaction chamber, and glow discharge is allowed to occur in the reaction chamber to form a non-single-crystal silicon layer such as a-Si(H,X) on a support 1101 fixed at the prescribed position in the reaction chamber.

The photoconductive layer 1103 is required to contain hydrogen atoms and/or halogen atoms in the present invention. The incorporation of the hydrogen atoms and/or the halogen atoms is indispensable to compensate the dangling bonds of the silicon atoms to improve the layer quality and to improve the photoconductivity and the charge-retaining properties. The content of the hydrogen atoms or the halogen atoms, or of the sum of the hydrogen and halogen atoms is preferably in the range of from 10 to 30 atomic %, more preferably from 15 to 25 atomic % based on the total of the silicon atoms and the hydrogen atoms and/or the halogen atoms.

The Si source gas useful in the present invention includes gaseous or gasifiable silicon hydrides (silanes) such as $SiH_4$, $Si_2H_6$, $Si_3H_8$, and $Si_4H_{10}$. Of these, $SiH_4$ and $Si_2H_6$ are preferred in view of ease of handling in the layer formation, and efficiency of Si supply.

The above gas is preferably mixed with $H_2$ and/or He, or a gas of a hydrogen-containing silicon compound in a desired ratio for formation of the layer in order to facilitate the control of introduction ratio of hydrogen atoms into the film structure and to obtain the film properties for achieving the object of the present invention. The respective gases used may be a single species, or combination of plural species.

The effective source gas for supplying halogen atoms in the present invention includes halogen gases, and gaseous or gasifiable halogen compounds such as halides, interhalogen compounds, and halogen-substituted silane derivatives. Also gaseous or gasifiable halogen-containing silicon hydride compounds having silicon and halogen as the constituting elements are useful. Specifically the halogen compound suitably used in the present invention includes fluorine gas ($F_2$), and interhalogen compounds such as BrF, ClF, $ClF_3$, $BrF_3$, $BrF_5$, $IF_3$, and $IF_7$. The halogen-containing silicon compound or a halogen-substituted silane derivatives include specifically silicon fluorides such as $SiF_4$, and $Si_2F_6$.

The amount of the hydrogen atoms and/or halogen atoms to be contained in the photoconductive layer 1103 can be controlled, for example, by the temperature of the support 1101, the amount of introduction of the source material for the hydrogen atoms and/or the halogen atoms into the reaction chamber, the electric discharge power, and so forth.

The photoconductive layer 1103 preferably contains atoms capable of controlling conductivity (conductivity-controlling atoms) as necessary in the present invention. The conductivity-controlling atoms may be uniformly distributed throughout the photoconductive layer 1103, or may be distributed nonuniformly in the thickness direction of the photoconductive layer 1103.

The conductivity-controlling atoms include so-called impurities in the semiconductor technical field such as atoms of Group 13 (or IIIb) of Periodic Table which give p-type conductivity (hereinafter referred to as "IIIb atoms"), and atoms of Group 15 or (Vb) of Periodic Table which give n-type conductivity (hereinafter referred to as "Vb atoms").

The IIIb atoms specifically include boron (B), aluminum (Al), gallium (Ga), indium (In), and thallium (Tl). Of these IIIb atoms, B, Al, and Ga are particularly preferred. The Vb atoms specifically include phosphorus (P), arsenic (As), antimony (Sb), and bismuth (Bi). Of these Vb atoms, P, and As are particularly preferred.

The content of the conductivity-controlling atoms in the photoconductive layer 1103 is preferably in the range of from $1\times10^{-2}$ to $1\times10^{4}$ atomic ppm, more preferably from $5\times10^{-2}$ to $5\times10^{3}$ atomic ppm, still more preferably from $1\times10^{-1}$ to $1\times10^{3}$ atomic ppm.

The conductivity-controlling atoms, including IIIb atoms or Vb atoms, are introduced structurally into the layer by introducing the source substance for the IIIb atoms or the Vb atoms in a gas state together with the source gas for the photoconductive layer 1103 into the reaction chamber. The source substance for introduction of the IIIb atoms or the Vb atoms is preferably in a gas state in an ordinary temperature and pressure or readily gasifiable at least under the layer forming conditions.

The source substance for introduction of the IIIb atoms specifically includes boron hydrides such as $B_2H_6$, $B_4H_{10}$, $B_5H_9$, $B_5H_{11}$, $B_6H_{10}$, $B_6H_{12}$, and $B_6H_{14}$ and boron halides such as $BF_3$, $BCl_3$, and $BBr_3$ for introduction of boron atoms; and $AlCl_3$, $GaCl_3$, $Ga(CH_3)_3$, $InCl_3$, and $TlCl_3$.

The source substance for introduction of the Vb atoms specifically includes phosphorus hydrides such as $PH_3$, and $P_2H_4$, and phosphorus halides such as $PH_4I$, $PF_3$, $PF_5$, $PCl_3$, $PCl_5$, $PBr_3$, $PBr_5$, and $PI_3$ for introduction of phosphorus atoms; and $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, and $BiBr_3$.

The source substance for introduction of the conductivity-controlling atoms may be diluted by $H_2$ and/or He as necessary.

The photoconductive layer 1103 may effectively contain carbon atoms and/or oxygen atoms and/or nitrogen atoms in the present invention. The content of the carbon atoms and/or oxygen atoms and/or nitrogen atoms is preferably in the range of from $1\times10^{-5}$ to 10 atomic %, more preferably from $1\times10^{-4}$ to 8 atomic %, still more preferably from $1\times10^{-3}$ to 5 atomic % based on the total amount of the silicon atoms, carbon atoms, oxygen atoms, and nitrogen atoms. The carbon atoms and/or oxygen atoms and/or nitrogen atoms may be uniformly distributed throughout the photoconductive layer, or may be distributed nonuniformly with variation of the content in the thickness direction of the photoconductive layer.

The thickness of the photoconductive layer 1103 is designed suitably in consideration of the intended electrophotographic properties and economical effects, and is preferably in the range of from 20 to 50 μm, more preferably from 23 to 45 μm, still more preferably from 25 to 40 μm.

The mixing ratio of the Si source gas and the dilution gas, the gas pressure in the reaction chamber, the electric discharge power, and the temperature of the support should be suitably selected in order to form a photoconductive layer having the desired layer properties to achieve the object of the present invention.

The flow rate of $H_2$ and/or He as the dilution gas is selected within a suitable range depending on the layer design. The ratio of the $H_2$ and/or He to the Si source gas is usually in the range of from 3 to 20, preferably from 4 to 15, more preferably from 5 to 10 based on volume.

The gas pressure in the reaction chamber is also selected within a suitable range depending on the layer design. The pressure is usually in the range of from $1\times10^{-4}$ to 10 Torr, preferably from $5\times10^{-4}$ to 5 Torr, more preferably from $1\times10^{-3}$ to 1 Torr.

The electric discharge power is also selected within a suitable range depending on the layer design. The discharge power is usually set by a factor of 2 to 7, preferably from 2.5 to 6, more preferably from 3 to 5 relative to the flow rate of the Si source gas.

The temperature of the support 1101 is selected within a suitable range depending on the layer design. The temperature is preferably in the range of from 200° to 350° C., more preferably from 230° to 330° C., still more preferably from 250° to 310° C.

The preferred ranges of the temperature of the support, and the gas pressure are mentioned above for the formation of the photoconductive layer. However, the respective conditions should not be decided independently, but should be decided organically to obtain a photoconductive member of desired properties.

[Surface Layer]

A surface layer 1104 of a non-single-crystal silicon type, such as of an amorphous silicon type, is preferably formed further on the aforementioned photoconductive layer 1103 on the support 1101 in the present invention. The surface layer 1104 having a surface 1106 is provided to improve moisture resistance, characteristics in repeated use, dielectric resistance, environmental resistance, and durability of the photoconductive layer to achieve the object of the present invention.

Since the photoconductive layer 1103 and the surface layer 1104 contain silicon atoms in common as the constituting element in the present invention, the layer interface is chemically stable sufficiently.

The surface layer 1104 may be made from any non-single-crystal silicon type material. The preferred material therefor includes amorphous silicon containing hydrogen atoms (H) and/or halogen atoms (X) and carbon atoms (hereinafter referred to as "a-SiC(H,X)"); amorphous silicon containing hydrogen atoms (H) and/or halogen atoms (X) and oxygen atoms (hereinafter referred to as "a-SiO(H,X)"); amorphous silicon containing hydrogen atoms (H) and/or halogen atoms (X) and nitrogen atoms (hereinafter referred to as "a-SiN (H,X)"); amorphous silicon containing hydrogen atoms (H) and/or halogen atoms (X) and at least one of carbon atoms, oxygen atoms, and nitrogen atoms (hereinafter referred to as "a-SiCON(H,X)"), and so forth.

The surface layer 1104 can be formed in the present invention by a vacuum deposition film-forming method under selected film-forming parameter conditions to achieve the object of the invention effectively. The thin film-forming method includes glow discharge (AC discharge CVD such as low frequency CVD, high frequency CVD, and microwave CVD, and DC discharge CVD), sputtering, vacuum vapor deposition, ion-plating, photo-assisted CVD, thermal CVD, and other thin film deposition methods. The thin film-forming method is selected in consideration of the production conditions, required capital investment, production scale, the required properties of the produced image-forming photosensitive member. In view of the productivity, the same film-forming method as for the photoconductive layer is preferably employed.

For example, in the glow discharge for formation of the surface layer 1104 of a-SiC(H,X), in principle, an Si source gas for supplying silicon atoms (Si), a C source gas for supplying carbon atoms, an H source gas for supplying hydrogen atoms (H) and/or an X source gas for supplying halogen atoms (X) are introduced in a suitable gas state into an evacuated reaction chamber, and glow discharge is allowed to occur in the reaction chamber to form a layer of a-SiC(H,X) on a photoconductive layer 1103 on a support 1101 fixed at the prescribed position in the reaction chamber.

The surface layer 1104 of the present invention may be made from any non-single-crystal material containing silicon. The preferred material therefor includes silicon compounds containing at least one element selected from carbon, nitrogen, and oxygen, in particular, those mainly composed of a-SiC. The a-SiC, the main component of the surface layer, contains the carbon at a content ranging from 30 to 90 atomic % based on the total amount of the silicon atoms and the carbon atoms.

The surface layer 1104 contains preferably hydrogen atoms and/or halogen atoms in the present invention. The incorporation of the hydrogen atoms and/or the halogen atoms is indispensable in the surface layer to compensate the dangling bonds of the silicon atoms to improve the layer quality and to improve the photoconductivity and the charge-retaining properties. The content of the hydrogen atoms is usually in the range of from 30 to 70 atomic %, preferably from 35 to 65 atomic %, more preferably from 40 to 60 atomic % based on the entire constituting atoms. The content of the fluorine atoms is usually in the range of from 0.01 to 15 atomic %, preferably from 0.1 to 10 atomic %, more preferably from 0.6 to 4 atomic %.

The photosensitive member which contains hydrogen and/or fluorine in the above content range is excellent for practical use. Specifically, the defects in the surface layer, which is caused mainly by dangling bonds of silicon atoms and carbon atoms, are known to give adverse effect to the characteristics of the image-forming photosensitive member: for example, deterioration of the charging characteristics caused by charge injection from the free surface to the photosensitive layer; variation of the charging characteristics caused by change of the surface structure under environmental conditions such as high humidity; and afterimage phenomenon in repeated use caused by trapping, by the aforementioned defects in the surface layer, of the charges injected from the photoconductive layer to the surface layer on corona charging or light irradiation.

The defects in the surface layer can be reduced remarkably by controlling the hydrogen content of the surface layer to be not lower than 30 atomic %, thereby significant improvement being achieved in electrical properties and high-speed continuous image formation.

However, a hydrogen content of 71 atomic % or more in the surface layer decreases hardness of the surface layer, and may make the surface layer less durable in repeated use for a long term. Therefore, the control of the hydrogen content in the above range is an important factor in obtaining the desired excellent electrophotographic properties. The hydrogen content of the surface layer can be controlled by the $H_2$ gas flow rate, support temperature, discharge power, gas pressures, and so forth.

By controlling the fluorine content of the surface layer to be not less than 0.01 atomic %, the bonding of the silicon atoms with the carbon atoms can be formed more effectively in the surface layer. The fluorine atoms serve also to prevent the scission of bonding between the silicon atoms and the carbon atoms caused by the damage by corona discharge in the surface layer.

At a fluorine content of higher than 15 atomic %, no or little effect is observed in formation of bonding between the silicon atoms and the carbon atoms and in prevention of scission of the bonding in the surface layer. Moreover, the excessive fluorine atoms abstracts the mobility of the carrier in the surface layer to make remarkable the residual potential and the image memory. Therefore, the control of the fluorine content in the surface layer within the above range is an important factor in obtaining the desired excellent electrophotographic properties. The fluorine content of the surface layer can be controlled similarly as the hydrogen content by the $F_2$ gas flow rate, the support temperature, discharge power, the gas pressures, and so forth.

The Si source gas useful for formation of the surface layer of the present invention includes gaseous or gasifiable silicon hydrides (silanes) such as $SiH_4$, $Si_2H_6$, $Si_3H_8$, and $Si_4H_{10}$. Of these, $SiH_4$ and $Si_2H_6$ are preferred in view of ease of handling in the layer formation, and efficiency of Si supply. The Si source gas may be diluted with another gas such as $H_2$, He, Ar, and Ne.

The C source gas useful for supplying the carbon includes gaseous or gasifiable hydrocarbons such as $CH_4$, $C_2H_6$, $C_3H_8$, and $C_4H_{10}$. Of these, $CH_4$ and $C_2H_6$ are preferred in view of ease of handling in the layer formation, and efficiency of Si supply. The C source gas may be diluted with another gas such as $H_2$, He, Ar, and Ne.

The source gas useful for supplying the nitrogen or oxygen includes gaseous or gasifiable compounds such as $NH_3$, NO, $N_2O$, $NO_2$, $H_2O$, $O_2$, CO, $CO_2$, and $N_2$. The nitrogen or oxygen source gas may be diluted with another gas such as $H_2$, He, Ar, and Ne.

To facilitate further the control of the ratio of introduction of hydrogen atoms into the formed surface layer 1104, the above gases are preferably diluted with a hydrogen gas or a hydrogen-containing silicon compound gas in a desired ratio for the layer formation. The respective gases may be either a single species or combination of plural species in a suitable mixing ratio.

The effective source gas for supplying halogen atoms includes halogen gas, and gaseous or gasifiable halogen compounds such as halides, interhalogen compounds, and halogen-substituted silane derivatives. Also gaseous or gasifiable halogen-containing silicon hydride compounds having silicon and halogen are preferable as the constituting elements. Specifically the halogen compound suitably used in the present invention includes fluorine gas ($F_2$), and interhalogen compounds such as BrF, ClF, $ClF_3$, $BrF_3$, $BrF_5$, $IF_3$, and $IF_7$. The halogen-containing silicon hydrides or a halogen-substituted silane derivatives include specifically silicon fluorides such as $SiF_4$, and $Si_2F_6$.

The amount of the hydrogen atoms and/or halogen atoms to be contained in the surface layer 1104 can be controlled, for example, by the temperature of the support 1101, the amount of introduction of the source material for the hydrogen atoms and/or the halogen atoms, the electric discharge power, and so forth.

The carbon atoms and/or oxygen atoms and/or nitrogen atoms may be uniformly distributed throughout the surface layer, or may be distributed nonuniformly in the thickness direction of the surface layer.

The surface layer 1104 preferably contains atoms capable of controlling the conductivity (conductivity-controlling atoms) as necessary in the present invention. The conductivity-controlling atoms may be uniformly distributed throughout the surface layer 1104, or may be distributed nonuniformly in the thickness direction thereof.

The conductivity-controlling atoms include so-called impurities in the semiconductor technical field, including Group IIIb atoms of Periodic Table which give p-type conductivity and Group Vb atoms of Periodic Table which give n-type conductivity as mentioned above.

The content of the conductivity-controlling atoms in the surface layer 1104 is preferably in the range of from $1\times10^{-3}$ to $1\times10^{3}$ atomic ppm, more preferably from $1\times10^{-2}$ to $5\times10^{2}$ atomic ppm, still more preferably from $1\times10^{-1}$ to $1\times10^{2}$ atomic ppm. The conductivity-controlling atoms such as IIIb atoms and Vb atoms are introduced structurally into the layer by introducing the source substance for the IIIb atoms or the Vb atoms in a gas state together with the source gas for formation of the surface layer 1104 into the reaction chamber. The source substance for introduction of the IIIb atoms or the Vb atoms is preferably in a gas state in an ordinary temperature and pressure or readily gasifiable at least under the layer forming conditions.

The source substance for introduction of the IIIb atoms specifically includes boron hydrides such as $B_2H_6$, $B_4H_{10}$, $B_5H_9$, $B_5H_{11}$, $B_6H_{10}$, $B_6H_{12}$, and $B_6H_{14}$ and boron halides such as $BF_3$, $BCl_3$, and $BBr_3$ for introduction of boron atoms; and $AlCl_3$, $GaCl_3$, $Ga(CH_3)_3$, $InCl_3$, and $TlCl_3$.

The source substance for introduction of the Vb atoms specifically includes phosphorus hydrides such as $PH_3$, and $P_2H_4$, and phosphorus halides such as $PH_4I$, $PF_3$, $PF_5$, $PCl_3$, $PCl_5$, $PBr_3$, $PBr_5$, and $PI_3$ for introduction of phosphorus atoms; and $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, and $BiBr_3$.

The source substance for introduction of the conductivity-controlling atoms may be diluted with another gas such as $H_2$, He, Ar, and Ne as necessary.

The surface layer 1104 of the present invention has preferably a thickness ranging usually from 0.01 to 3 μm, preferably from 0.05 to 2 μm, more preferably from 0.1 to 1 μm. The surface layer having a thickness of less than 0.01 μm will come to be lost owing to wearing and other causes during the use of the photosensitive member, whereas the surface layer having a thickness of more than 3 μm will impair the electrophotographic characteristics such as increase of residual potential.

The surface layer 1104 of the present invention is formed carefully to obtain the required characteristics as desired. Depending on the formation conditions, the substance composed of Si, C and/or N and/or O, and H and/or X changes in structure from a crystal state to an amorphous state; in electric properties from an electroconductive state through a semiconductive state to an insulating state; and in photoconductive properties from a photoconductive state to a non-photoconductive state. Therefore, the layer formation is conducted with strict selection of the formation conditions to obtain a compound of the intended properties.

When the surface layer 1104 is provided mainly for improvement of the dielectric strength, for example, the layer is formed in a state of a non-single-crystal material which shows remarkable insulating behavior under the apparatus operation conditions.

When the surface layer 1104 is provided mainly for improvement of the continuous repetitive operation characteristics and the independence from environmental conditions, the layer is formed in a state of a non-single-crystal material which is a little less insulating and is a little more sensitive to introduced light.

The resistivity of the surface layer is preferably controlled to be at a suitable level to prevent the image smearing caused by the lower resistivity thereof, to prevent adverse effects of the residual potential, and to obtain a high charging efficiency with the charging mechanism of the present invention.

To obtain a surface layer 1104 having the characteristics for achieving the object of the present invention, the temperature of the support 1101, and the gas pressure in the reaction chamber should be controlled suitably.

The temperature of the support (Ts) is selected within a suitable range depending on the layer design. The temperature range is preferably in the range of from 200° to 350° C., more preferably from 230° to 330° C., still more preferably from 250° to 300° C.

The gas pressure in the reaction chamber is also selected within a suitable range depending on the layer design. The pressure is usually, in the range of from $1\times10^{-4}$ to 10 Torr, preferably from $5\times10^{-4}$ to 5 Torr, more preferably from $1\times10^{-3}$ to 1 Torr.

The preferred ranges of the temperature of the support, and the gas pressure are mentioned above for the formation of the surface layer. However, the respective conditions should not be decided independently, but should be decided organically to obtain a photosensitive member of desired properties.

A blocking layer (lower surface layer) which contains less amount of carbon atoms, oxygen atoms, or nitrogen atoms than the surface layer may additionally be provided between the surface layer and the photoconductive layer to improve further the characteristics such as chargeability.

Between the surface layer 1104 and the photoconductive layer 1103, a region may be provided in which the contents of carbon atoms and/or oxygen atoms and/or nitrogen atoms decreases toward the photoconductive layer 1103. Such a region improves the adhesiveness between the surface layer and the photoconductive layer, and reduces the influence of interference by light reflection at the interface.

[Charge Injection-Inhibiting Layer]

A charge injection-inhibiting layer is more effectively provided between the electroconductive support and the photoconductive layer in the present invention to inhibit charge injection from the electroconductive support side. The charge injection-inhibiting layer has polarity dependence, and performs a function of inhibiting charge injection from the support side into the photoconductive layer side when the photosensitive layer surface is subjected to charging with a certain polarity, but does not perform that function when it is subjected to charging with the opposite polarity. For imparting such a function, the charge injection-inhibiting layer is made to contain relatively larger amount of conductivity-controlling atoms than the photoconductive layer.

The conductivity-controlling atoms in the charge injection-inhibiting layer may be uniformly distributed throughout the layer, or may be distributed continuously but nonuniformly in the layer thickness direction. In the case of nonuniform distribution, the conductivity-controlling atoms are preferably distributed in higher concentration toward the support side. However, in any case the distribution should be uniform in a plane direction parallel to the surface of the support for the uniformity of the properties in the plane direction.

The conductivity-controlling atoms contained in the charge injection-inhibiting layer include so-called impurities in the semiconductor technical field, including Group IIIb atoms of Periodic Table which gives p-type conductivity and Group Vb atoms of Periodic Table which gives n-type conductivity as mentioned above.

The content of the conductivity-controlling atoms in the charge injection-inhibiting layer is preferably in the range of from 10 to $1\times10^{4}$ atomic ppm, more preferably from 50 to $5\times10^{3}$ atomic ppm, still more preferably from $1\times10^{2}$ to $1\times10^{3}$ atomic ppm to achieve effectively the object of the present invention.

The charge injection-inhibiting layer may contain any of carbon atoms, nitrogen atoms, and oxygen atoms to improve further the adhesiveness with the adjacent layers in direct contact with it.

The carbon, nitrogen, or oxygen atoms in the charge injection-inhibiting layer may be uniformly distributed throughout the layer, or may be distributed continuously but nonuniformly in the layer thickness direction. However, in any case the distribution should be uniform in a plane direction parallel to the surface of the support for the uniformity of the properties in the plane direction.

The total content of the carbon, and/or nitrogen, and/or oxygen atoms in the charge injection-inhibiting layer of the present invention is selected suitably to achieve the object of the present invention, ranging preferably from $1\times10^{-3}$ to 50 atomic %, more preferably from $5\times10^{-3}$ to 30 atomic %, still more preferably from $1\times10^{-2}$ to 10 atomic %.

The hydrogen atoms and/or halogen atoms contained in the charge injection-inhibiting layer of the present invention improve the layer properties by compensating the dangling bonds in the layer. The content of the hydrogen atoms or the halogen atoms, or of the sum of the hydrogen and halogen atoms in the charge injection-inhibiting layer is preferably in the range of from 1 to 50 atomic %, more preferably from 5 to 40 atomic %, still more preferably from 10 to 30 atomic %.

The thickness of the charge injection-inhibiting layer in the present invention is designed suitably in consideration of the intended electrophotographic properties and economical effects, and is preferably in the range of from 0.1 to 5 μm, more preferably from 0.3 to 4 μm, still more preferably from 0.5 to 3 μm.

The charge injection-inhibiting layer can be formed by vacuum deposition in the same manner as the aforementioned photoconductive layer in the present invention.

In formation of the charge injection-inhibiting layer 1105, the mixing ratio of the Si source gas and the dilution gas, the gas pressure in the reaction chamber, the electric discharge power, and the temperature of the support 1101 should be suitably selected, similarly to the case of the photoconductive layer.

The flow rate of $H_2$ and/or He as the dilution gas is selected within a suitable range depending on the layer design. The ratio of the $H_2$ and/or He to the Si source gas is usually in the range of from 1 to 20, preferably from 3 to 15, more preferably from 5 to 10 based on volume.

The gas pressure in the reaction chamber is also selected within a suitable range depending on the layer design. The pressure is usually in the range of from $1\times10^{-4}$ to 10 Torr, preferably from $5\times10^{-4}$ to 5 Torr, more preferably from $1\times10^{-3}$ to 1 Torr.

The electric discharge power is also selected within a suitable range depending on the layer design. The discharge power is usually set by a factor of 1 to 7, preferably from 2 to 6, more preferably from 3 to 5 relative to the flow rate of the Si source gas.

The temperature of the support 1101 is selected within a suitable range depending on the layer design. The temperature is preferably in the range of from 200° to 350° C., more preferably from 230° to 330° C., still more preferably from 250° to 300° C.

The preferred ranges of the mixing ratio of the dilution gas, the gas pressure, the discharge power, and the temperature of the support are mentioned above for the formation of the charge injection-inhibiting layer. However, the respective conditions cannot be decided independently, but are desirably decided organically to form a charge injection-inhibiting layer having desired properties.

The photosensitive layer 1102 of the photosensitive member for an image-forming apparatus of the present invention has preferably a layer region at a side of the support 1101, where at least aluminum, silicon, hydrogen, and or/halogen atoms are distributed nonuniformly in the layer thickness direction.

The photosensitive member for an image-forming apparatus of the present invention has preferably an adhesion layer between the support 1101 and the photoconductive layer 1103 or the charge injection-inhibiting layer 1105 to improve further the adhesiveness between the layers. The adhesion layer is constituted, for example, of an amorphous material composed of $Si_3N_4$, $SiO_2$, SiO, or silicon atoms as a matrix and containing hydrogen atoms and/or halogen atoms, and carbon atoms and/or oxygen atoms and/or nitrogen atoms. Further, a light absorption layer may be provided to prevent occurrence of interference fringes caused by light reflected from the support.

[Surface]

The surface 1106 of the photosensitive member has a resistivity preferably in the range of from $1\times10^{10}$ to $1\times10^{15}$ Ωcm.

An apparatus for forming the photosensitive member, and a method for forming the film are explained below in detail.

Figure 5:
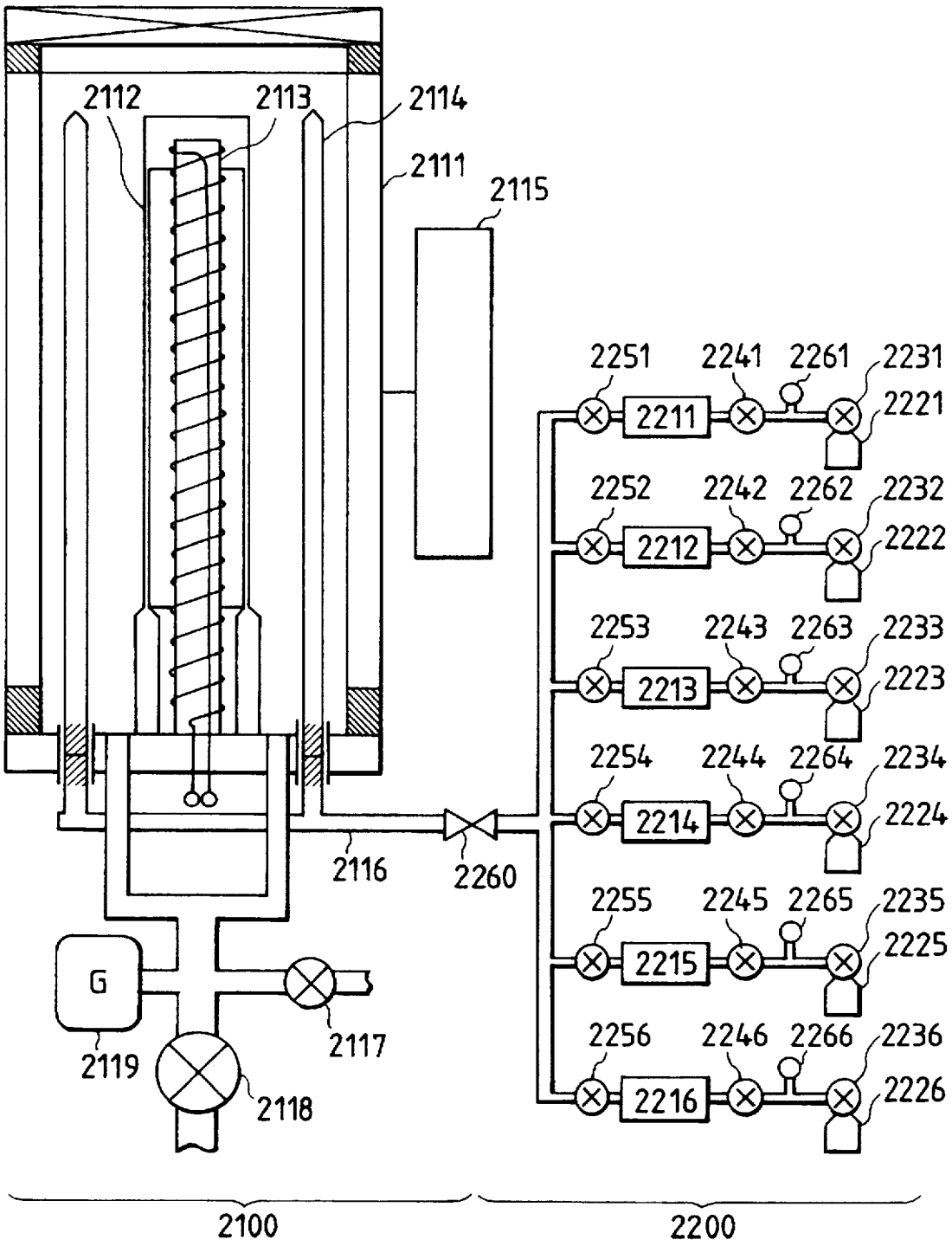
FIG. 5 illustrates schematically an example of the apparatus for forming a light-receiving layer of the photosensitive member of the image-forming apparatus of the present invention according to glow discharge employing high frequency of RF band.

FIG. 5 illustrates schematically a constitution of an apparatus for producing a photosensitive member for an image-forming apparatus by high frequency plasma CVD (hereinafter referred to as "RF-PCVD") employing an RF band as the power source frequency.

This apparatus is constituted basically of a deposition system 2100, a gas-feeding system 2200 for feeding source gases, and an evacuation system (not shown in the drawing) for evacuating the internal space of a reaction chamber 2111. A cylindrical support 2112, a heater 2113 for heating the support, and source gas introducing pipes 2114 are provided in the reaction chamber 2111 in the deposition system 2100. A high frequency matching box 2115 is connected to the reaction chamber 2111.

The source gas-feeding system 2200 comprises gas cylinders 2221–2226 of the source gases of $SiH_4$, $GeH_4$, $H_2$, $CH_4$, $B_2H_6$, $PH_3$, and the like, valves 2231–2236, 2241–2246, and 2251–2256, and mass flow controllers 2211–2216. The source gas cylinders are connected through a valve 2260 to the gas-introducing pipes 2114 in the reaction chamber 2111.

With this apparatus, a deposition film is formed, for example, as below.

A cylindrical support 2112 is placed in a reaction chamber 2111, and the internal space of the reaction chamber 2111 is evacuated by an evacuation system (e.g., a vacuum pump) not shown in the drawing. Then the cylindrical support 2112 is heated by a support heater 2113, and are kept at a prescribed temperature ranging from 200° to 350° C.

The source gases for deposition film formation are introduced into the reaction chamber 2111 through the steps below. Valves 2231–2236 of gas cylinders and a leak valve 2117 of the reaction chamber are confirmed to be closed; inlet valves 2241–2246, outlet valves 2251–2256, and an auxiliary valve 2260 are confirmed to be opened; and then the internal space of the reaction chamber 2111 and gas piping 2116 are evacuated by opening the main valve 2118. When the reading of a manometer 2119 has reached about $5\times10^{-6}$ Torr, the auxiliary valve 2260 and the outlet valves 2251–2256 are closed.

Then, gas cylinder valves 2231–2236 are opened to feed the respective source gases from gas cylinders 2221–2226. The pressures of the respective source gases are controlled, for example, to be 2 kg/cm$^2$ by pressure controllers 2261–2266. The inlet valves 2241–2246 are opened gradually to introduce the respective gases to mass controllers 2211–2216.

After the apparatus is made ready for film formation as described above, the layers are formed as explained below. When the cylindrical support 2112 has reached the prescribed temperature, necessary ones of the outlet valves 2251–2256 and the auxiliary valve 2260 are opened gradually to feed necessary gases from the gas cylinders 2221–2226 through the gas-introducing pipes 2114 into the reaction chamber 2111. The flow rates of the respective source gases are controlled to be at prescribed levels by the mass controllers 2211–2216. Simultaneously, the opening of the main valve 2118 is adjusted to keep the internal pressure of the reaction chamber 2111 at a prescribed pressure of not higher than 1 Torr by monitoring a manometer 2119. When the internal pressure has become steady, an RF power source (not shown in the drawing) of frequency 13.56 MHz is set at a prescribed power level, and the RF power is introduced through a high frequency matching box 2115 into the reaction chamber 2111 to generate glow discharge. The source gases introduced into the reaction chamber are decomposed by the discharge energy to form a deposition film mainly composed of silicon on the cylindrical support 2112. When the layer has been formed in a desired thickness, the RF power supply is stopped, and the outlet valves are closed to stop the gas introduction to the reaction chamber and to finish the formation of the photoconductive layer.

A desired multiple layered photosensitive layer is formed by repeating the above operations.

In formation of each of the layers, naturally, only the outlet valves of the necessary source gases are opened. After formation of each of the layers, the remaining gases are removed as necessary from the reaction chamber 2111 and piping between the outlet valves 2251–2256 to the reaction chamber 2111 by evacuating the system to a high vacuum with the outlet valves 2251–2256 closed, the auxiliary valve 2260 opened, and the main valve 2118 fully opened.

For uniformity of the formed layer, the support 2112 may effectively be rotated by a driving device (not shown in the drawing) at a prescribed speed during the layer formation.

Naturally, the employed gas species and the valve manipulation are changed according to the respective layer forming conditions.

Next, another process is explained for producing a photosensitive member for an image-forming apparatus according to high-frequency plasma CVD employing VHF band frequency as the power source (hereinafter referred to as "VHF-PCVD").

Figure 6:
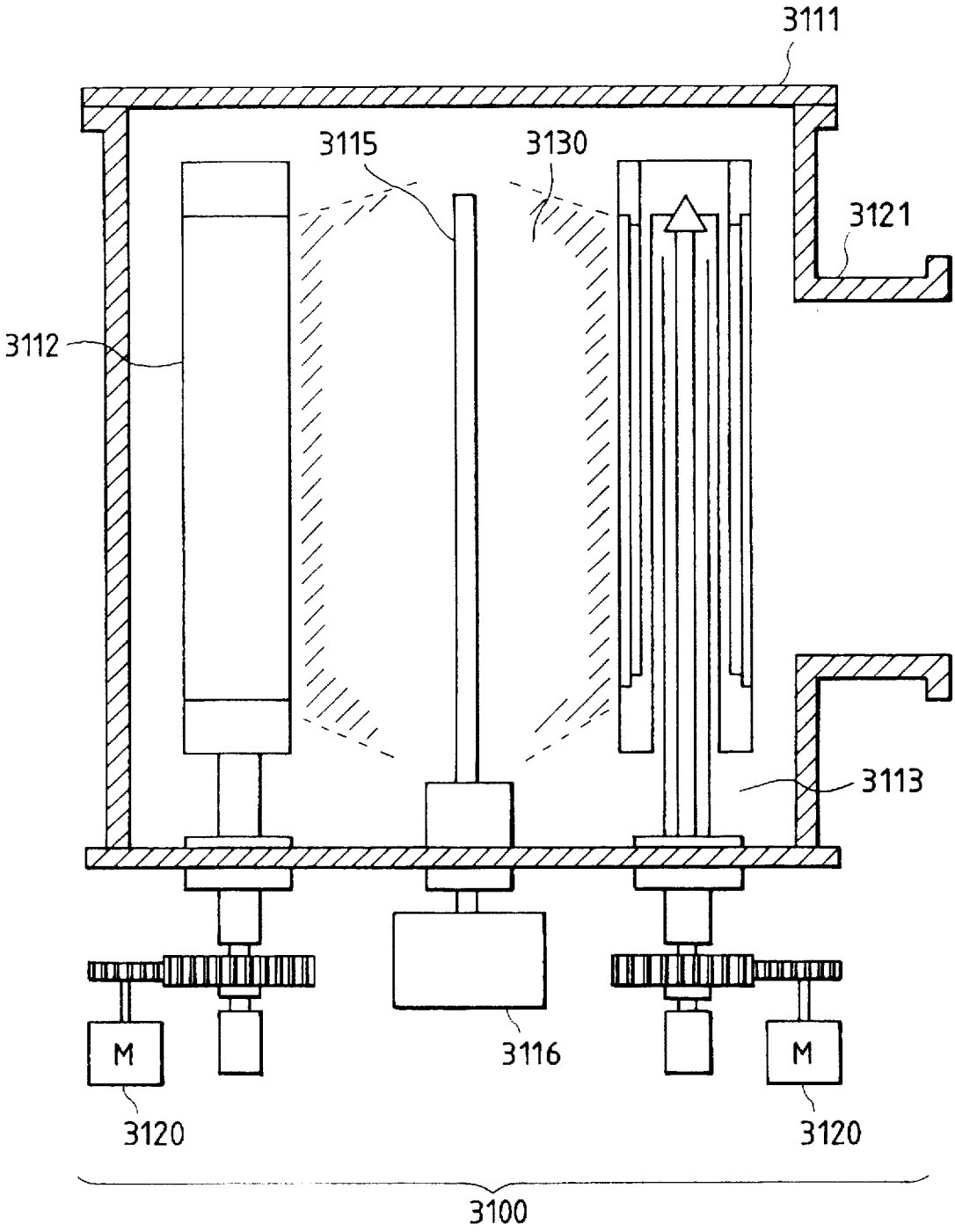
FIG. 6 illustrates schematically an example of the apparatus for forming a light-receiving layer of the photosensitive member of the image-forming apparatus of the present invention according to glow discharge employing high frequency of VHF band.

A VHF-PCVD apparatus for photosensitive member production is derived by replacing the RF-PCVD system 2100 of the production apparatus with a deposition system 3100 in FIG. 6 and connecting it with the source gas supplying system 2200.

This apparatus for VHF-PCVD is constituted basically of a deposition system 3100 comprising a vacuum-tight reaction chamber 3111, a gas-feeding system 2200 for feeding source gases, and an evacuation system (not shown in the drawing) for evacuating the internal space of a reaction chamber 3111. Cylindrical supports 3112, heaters 3113 for heating the supports, source gas introducing pipes (not shown), and electrodes are provided in the reaction chamber 3111. A high frequency matching box 3120 is connected to the electrodes. The internal space of the reaction chamber 3111 is communicated through an evacuating aperture 3121 to a diffusion pump not shown in the drawing.

The source gas-feeding system 2200 comprises gas cylinders 2221–2226 of the source gases of $SiH_4$, $GeH_4$, $H_2$, $CH_4$, $B_2H_6$, $PH_3$, and the like, valves 2231–2236, 2241–2246, and 2251–2256, and mass flow controllers 2211–2216. The source gas cylinders are connected through a valve 2260 to the gas-introducing pipes (not shown) in the reaction chamber 3111. The space 3130 surrounded by the cylindrical supports 3115 forms the discharge space.

With this VHF-PCVD apparatus, a deposition film is formed, for example, as below.

The cylindrical supports 3115 are placed in a reaction chamber 3111, the supports 3115 are rotated by the driving mechanism 3120, and the internal space of the reaction chamber 3111 is evacuated to a pressure of $1\times10^{-7}$ Torr or lower through the evacuation aperture 3121 by an evacuation system (e.g., a vacuum pump) not shown in the drawing. Then the cylindrical supports 3115 are heated by support heaters 3116, and are kept at a prescribed temperature ranging from 200° to 350° C.

The source gases for deposition film formation are introduced into the reaction chamber 3111 through the steps below. Valves 2231–2236 of gas cylinders and a leak valve 2117 of the reaction chamber are confirmed to be closed; inlet valves 2241–2246, outlet valves 2251–2256, and an auxiliary valve 2260 are confirmed to be opened; and then the internal space of the reaction chamber 3111 and gas piping (not shown) are evacuated by opening the main valve (not shown in the drawing). When the reading of a manometer (not shown in the drawing) has reached about $5\times10^{-6}$ Torr, the auxiliary valve 2260 and the outlet valves 2251–2256 are closed.

Then, gas cylinder valves 2231–2236 are opened to feed the respective source gases from gas cylinders 2221–2226. The pressures of the respective source gases are controlled to be, for example, at 2 kg/cm$^2$ by pressure controllers 2261–2266. The inlet valves 2241–2246 are opened gradually to introduce the respective gases to mass controllers 2211–2216.

After the apparatus is made ready for film formation as described above, the layers are formed on the cylindrical supports 3115 as explained below.

When the cylindrical support 3115 have reached the prescribed temperature, necessary ones of the outlet valves 2251–2256 and the auxiliary valve 2260 are opened gradually to feed necessary gases from the gas cylinders 2221–2226 through the gas-introducing pipe (not shown) into discharging space 3130 in the reaction chamber 3111. The flow rates of the respective source gases are controlled to be at prescribed levels by the mass flow controllers 2211–2216. Simultaneously, the opening of the main valve (not shown in the drawing) is adjusted to keep the pressure in the discharge space 3130 at a prescribed pressure of not higher than 1 Torr by monitoring a manometer (not shown in the drawing).

When the internal pressure has become steady, a VHF power source (not shown in the drawing) of frequency 500 MHz is set at a prescribed power level, and the VHF power is introduced through a matching box 3120 into the discharge space 3130 to generate glow discharge. The source gases introduced into the discharge space 3130 surrounded by the supports 3115 are activated and decomposed by the discharge energy to form an intended deposited film on the cylindrical support 3115. For uniformity of the formed layer, the supports are rotated by a support-rotating motor 3120 at a prescribed speed during the layer formation.

When the layer has been formed in a desired thickness, the VHF power supply is stopped, and the outlet valves are closed to stop the gas introduction to the reaction chamber and to finish the formation of the photoconductive layer.

A desired photosensitive layer of multi-layer structure is formed by repeating the above operations.

In formation of each of the layers, naturally, only the outlet valves of the necessary source gases are opened. After formation of each of the layers, the remaining gases are removed as necessary from the reaction chamber 3111 and piping between the outlet valves 2251–2256 to the reaction chamber 3111 by evacuating the system to a high vacuum with the outlet valves 2251–2256 closed, the auxiliary valve 2260 opened, and the main valve (not shown in the drawing) fully opened.

Naturally, the employed gas species and the valve manipulation are changed according to the respective layer forming conditions.

In any of the above layer forming methods, the temperature of the support is kept in the range of preferably from 200° to 350° C., more preferably from 230° to 330° C., still more preferably from 250° C. to 300° C.

The heating of the support may be conducted by any heater designed for vacuum use. The heater specifically includes resistance heaters such as coiled sheathed heaters, plate-shaped heaters, and ceramic heaters; heat radiation lamps such as halogen lamps, infrared light lamps; and heaters with heat exchanger employing gaseous of liquid heating medium. The material of the surface of the heating means includes metals such as stainless steel, nickel, aluminum, and copper; ceramics, and heat-resistant polymer resins.

In another heating method, the support is heated in a separate heating vessel, and the heated support is delivered in vacuum to the reaction chamber.

Particularly in the VHF-PCVD process, the pressure of the discharge space is kept in the range of preferably from 1 to 500 mTorr, more preferably from 3 to 300 mTorr, still more preferably from 5 to 100 mTorr.

In the VHF-PCVD process, the electrode provided in the discharge space may be in any size and shape on condition that the discharge is not disturbed. Practically the electrode is preferably a cylinder having a diameter ranging from 1 mm to 10 cm. The length of the electrode is not limited if the electric field is applied uniformly to the supports.

The material of the electrode may be any material which has an electroconductive surface, including metals such as stainless steel, Al, Cr, Mo, Au, In, Nb, Te, V, Ti, Pt, Pb, and Fe, and alloys thereof; and glass, ceramics, and plastics treated for electroconductivity at the surface.

Desired effects can be obtained by employing, separately or in combination, the above-mentioned means and functions to solve the problems.

The effects of the present invention is specifically explained by reference to Experiment Examples without limiting the invention thereby.

EXPERIMENT EXAMPLE 1

The experiment was conducted with the charging member and the charging object shown in FIGS. 3A and 3B. A magnetic brush layer 301 is comprised of a powdery magnetite having particle diameters ranging from 10 to 50 μm. A multipolar magnetic body (ferrite magnet) 302 gives a magnetic field having a magnetic line density of 1000 G at the distance of 1 mm from the surface of the magnetic body 302 at the magnetic pole position. The magnetic brush layer 301 and the multipolar magnetic body 302 constitute a contact type charging member 300. Spacers 303 regulate the gap 308 between the contact type charging member 300 and the charging object 304. A plate-shaped member 305 regulates the thickness 307 of the magnetic brush layer. The numeral 306 indicates the nip breadth.

The multipolar magnetic body is a plastic magnet in a roller shape of 18 mm diameter, and has preferably plural magnetic poles within the nip breadth 306. In this Experiment Example, the magnet had 6 to 18 magnet poles.

The brush layer 301 was formed from a charging carrier composed of a mixture of magnetic iron oxide of 10–50 μm diameter and a magnetic powder of mag in a prescribed mixing ratio. The charging carrier may be of the same components as a known carrier used as a toner.

The plate-shaped member 305 is displaceable at the both ends respectively to regulate the distance from the multipolar magnetic body 302 and to control the thickness 307 of the magnetic brush layer. Thereby, the nip breadth 306 at the gap 308 between the contact type charging member and the photosensitive member can be regulated in the length direction. In this Experiment, the nip breadth was adjusted to be 6–7 mm.

Figure 7:
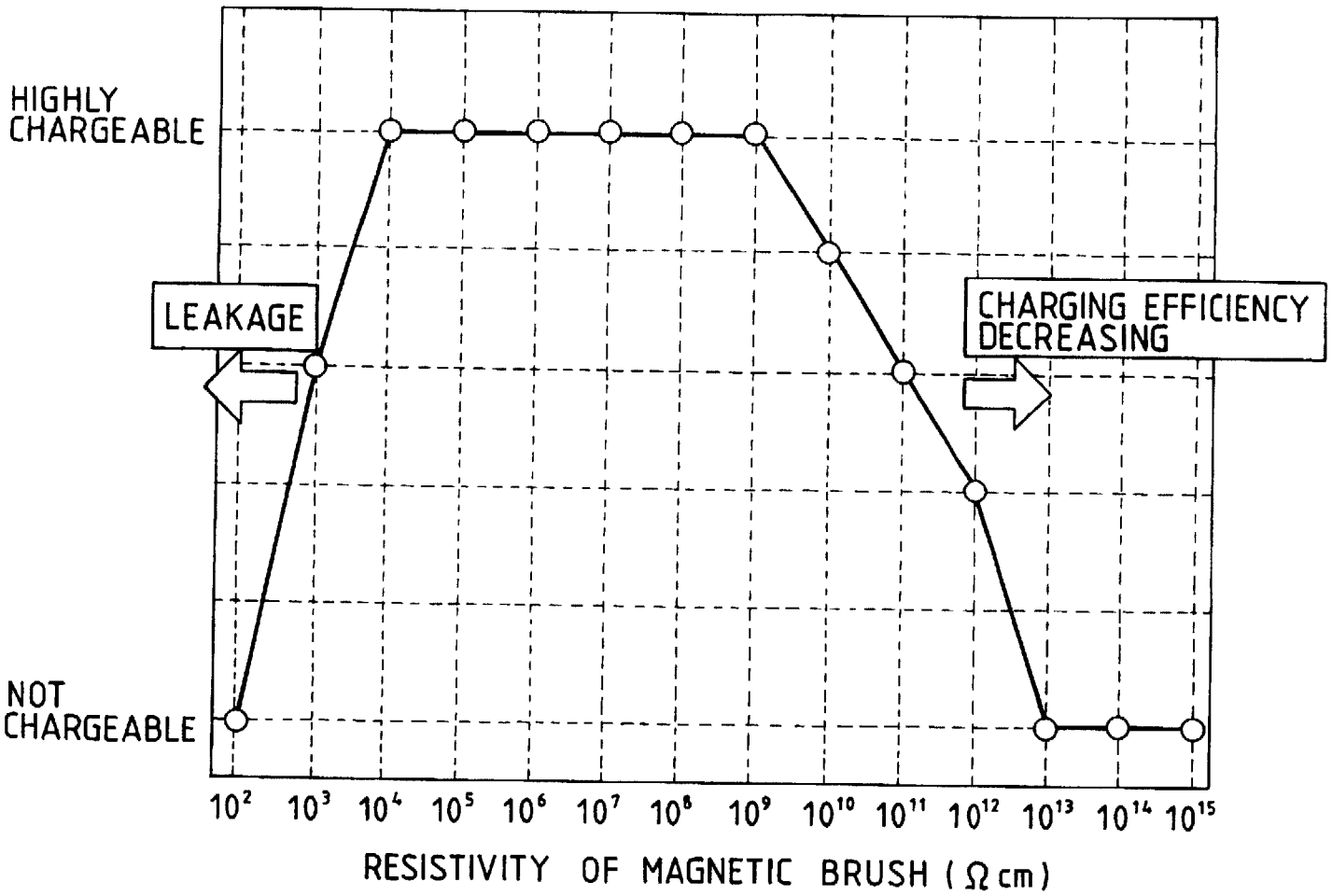
FIG. 7 is a graph showing an example of the dependency of the charged state of the charging object on the resistance of the brush layer of the charging member of the present invention.

Since the charging efficiency depends on the resistivity of the magnetic brush layer, several magnetic brushes were prepared which have different resistivities. FIG. 7 shows the chargeability of the above charging device. The resistivity of the magnetic brush layer was measured by a MΩ tester of HIOKI Co. at application voltage of 500 V.

As shown in FIG. 7, the resistivity of the magnetic brush layer is preferably in the range of from $1\times10^3$ to $1\times10^{12}$ Ωcm, more preferably from $1\times10^4$ to $1\times10^9$ Ωcm to achieve satisfactory charging efficiency and to prevent pinhole formation.

EXPERIMENT EXAMPLE 2

Figure 8A:
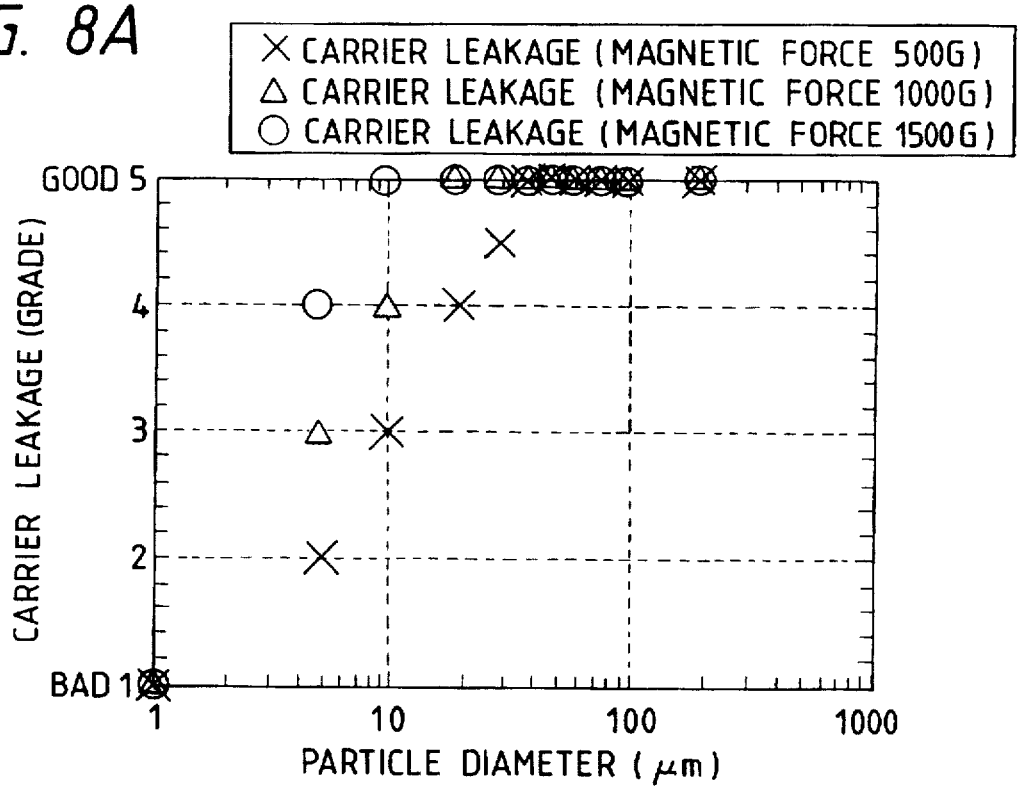
FIGS. 8A and 8B are graphs showing examples of the dependency of carrier leakage, brush-rubbing unevenness, and image smearing on the particle diameters of the magnetic powder of the charging member, and the magnetic force of the multipolar magnetic body of the present invention.
Figure 8B:
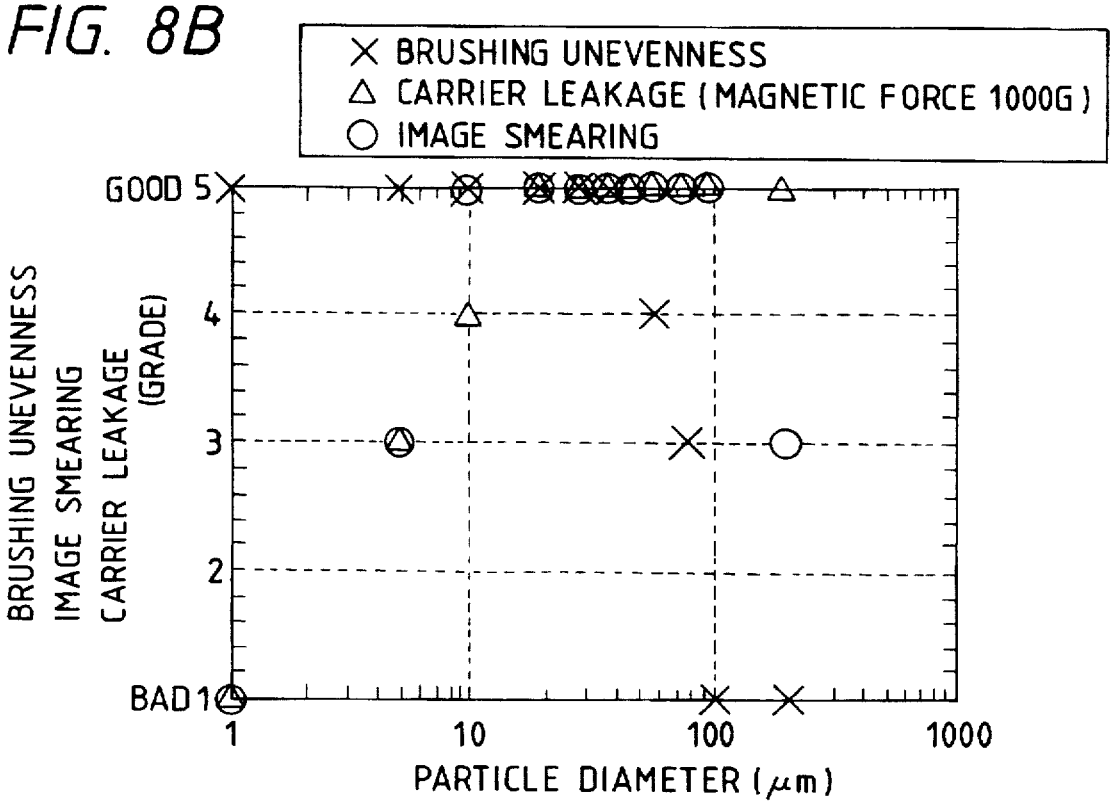

The same apparatus was used as in Experiment Example 1. The resistivity of the magnetic brush layer was adjusted to $1\times10^7$ Ωcm. Several magnetic powders were provided which had different charging carrier diameters, and several multipolar magnets were provided which had different magnetic forces. FIGS. 8A and 8B show the chargeability.

As shown FIGS. 8A and 8B, to prevent carrier leakage, image smearing and brushing uneveness, the charging carrier has preferably the particle diameter in the range of from 5 to 80 μm, more preferably from 10 to 50 μm, and the multipolar magnetic body has preferably magnetic force of not lower than 500 G, more preferably not lower than 1000 G.

EXPERIMENT EXAMPLE 3

Figure 9:
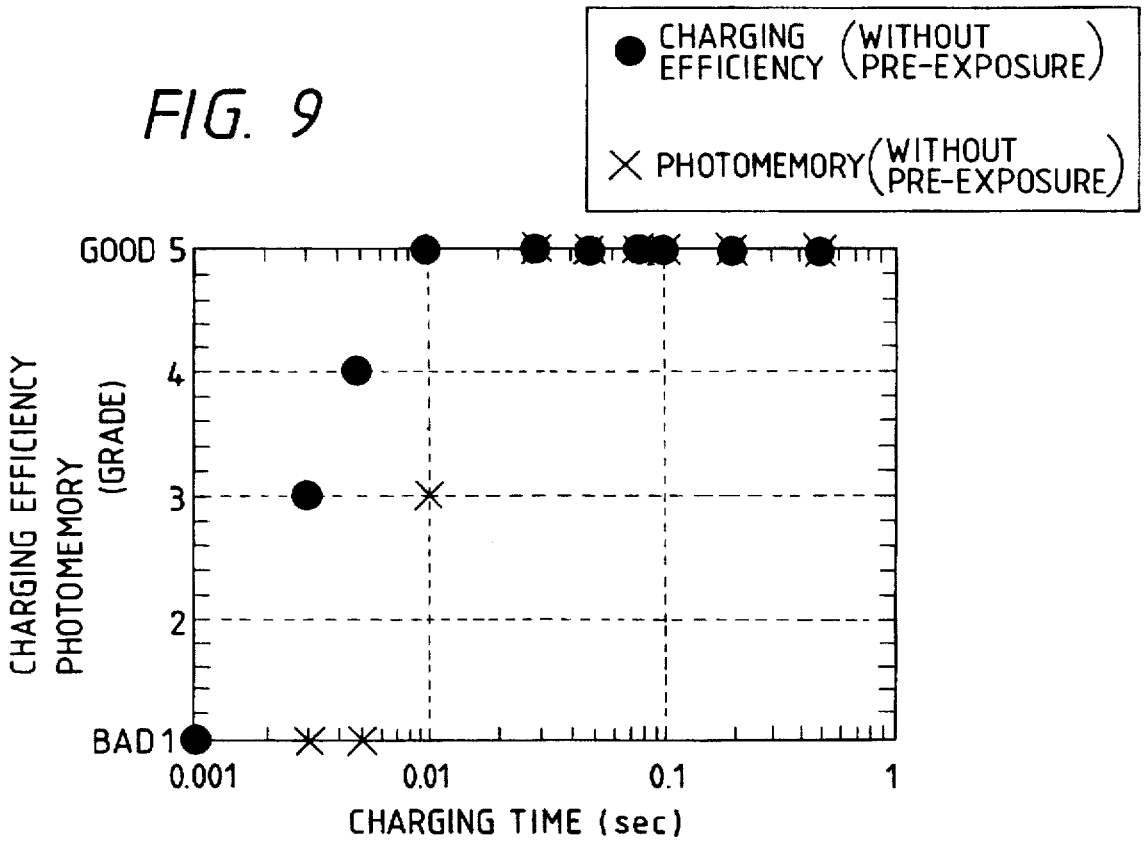
FIG. 9 and FIG. 10 are graphs showing respectively an example of the dependency of the charged state and the photomemory of the photosensitive member on the charging time in the present invention.

The same apparatus was used as in Experiment Example 1. The resistivity of the magnetic brush layer was adjusted to $1\times10^7$ Ωcm. The rotation speed of the charging object was changed to change the time of contact of the contact type charging member with the magnetic brush (hereinafter the time being referred to as "charging time"). The chargeability was investigated with or without light exposure for charge removal before the subsequent charging (hereinafter referred to as "pre-exposure"). FIG. 9 shows the results.

As shown in FIG. 9, the charging time is preferably not less than 10 msec (0.01 sec).

EXPERIMENT EXAMPLE 4

Figure 1:
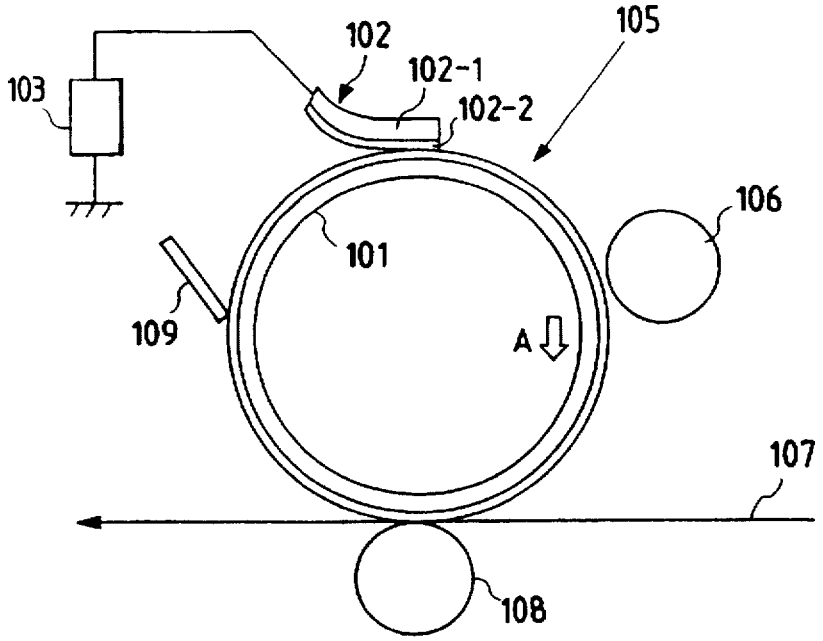
FIG. 1 PRIOR ART
FIG. 1 illustrates schematically an example of assemblage of a charging member for contact charging, a charging device, and an image-forming device.
Figure 2A:
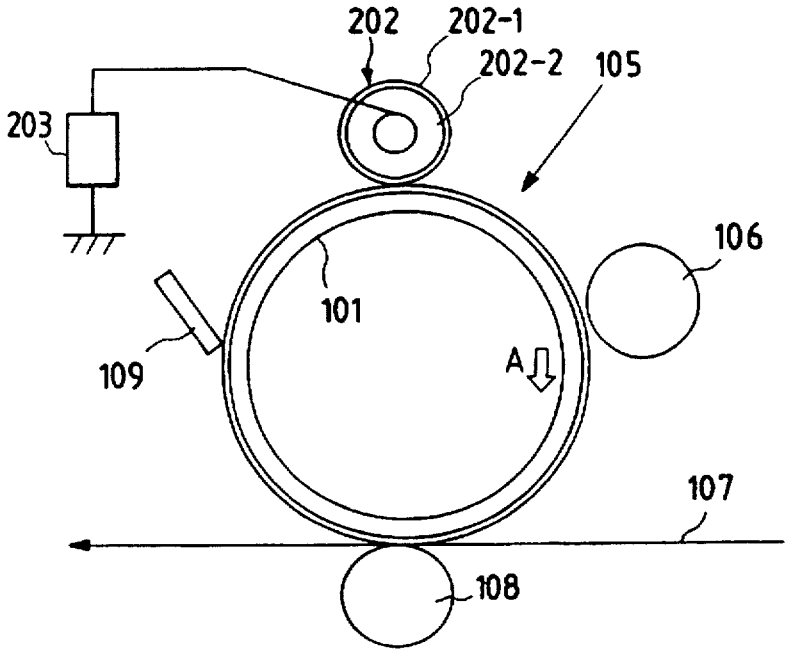
FIG. 2A PRIOR ART
FIGS. 2A and 2B illustrate schematically an example of assemblage of a charging member employing a magnetic brush, a charging device, and an image-forming device.
Figure 2B:
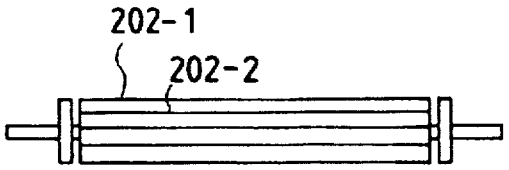
FIG. 2B PRIOR ART

The experiment was conducted with an image-forming apparatus shown in FIGS. 2A and 2B employing a contact type charging system shown in FIGS. 3A and 3B. The constitution of the apparatus is the same as that described above.

Figure 10:
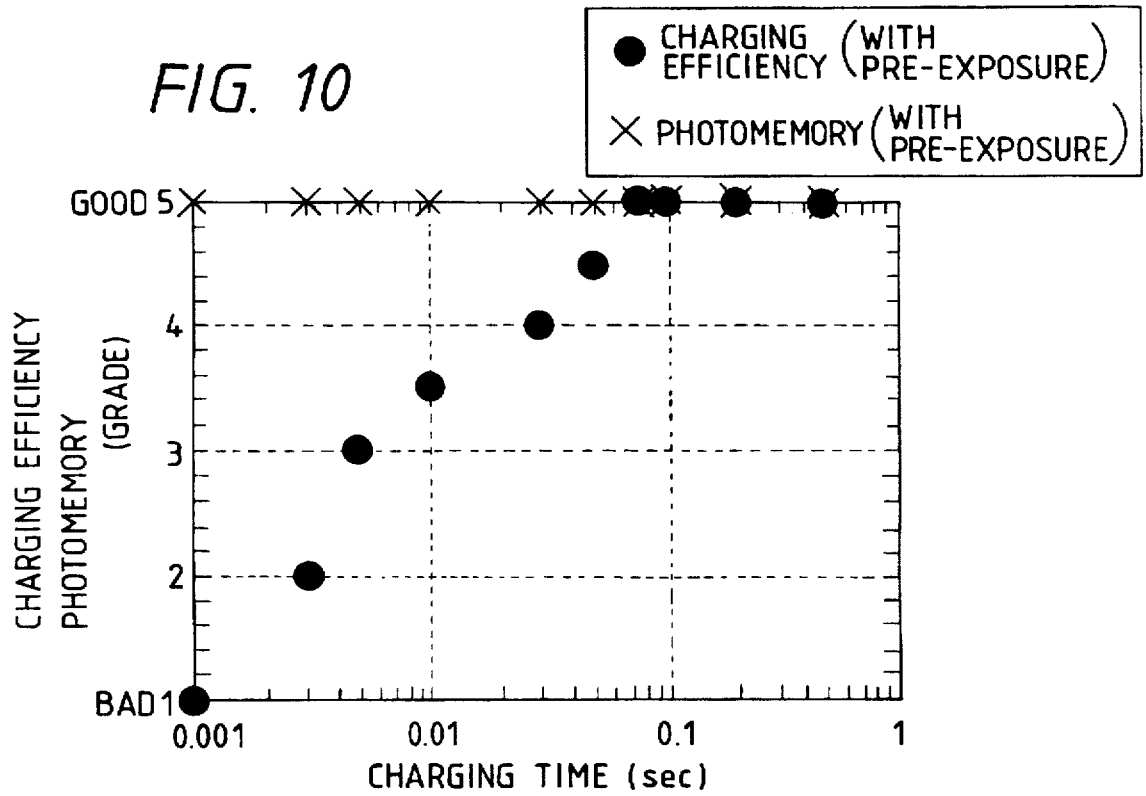

In this experiment, the rotation speed of the charging object was changed to change the contact time. The photomemory was investigated with or without pre-exposure. FIG. 10 shows the results.

As shown in FIG. 10, the charging time is preferably not less than 10 msec.

EXPERIMENT EXAMPLE 5

Figure 11:
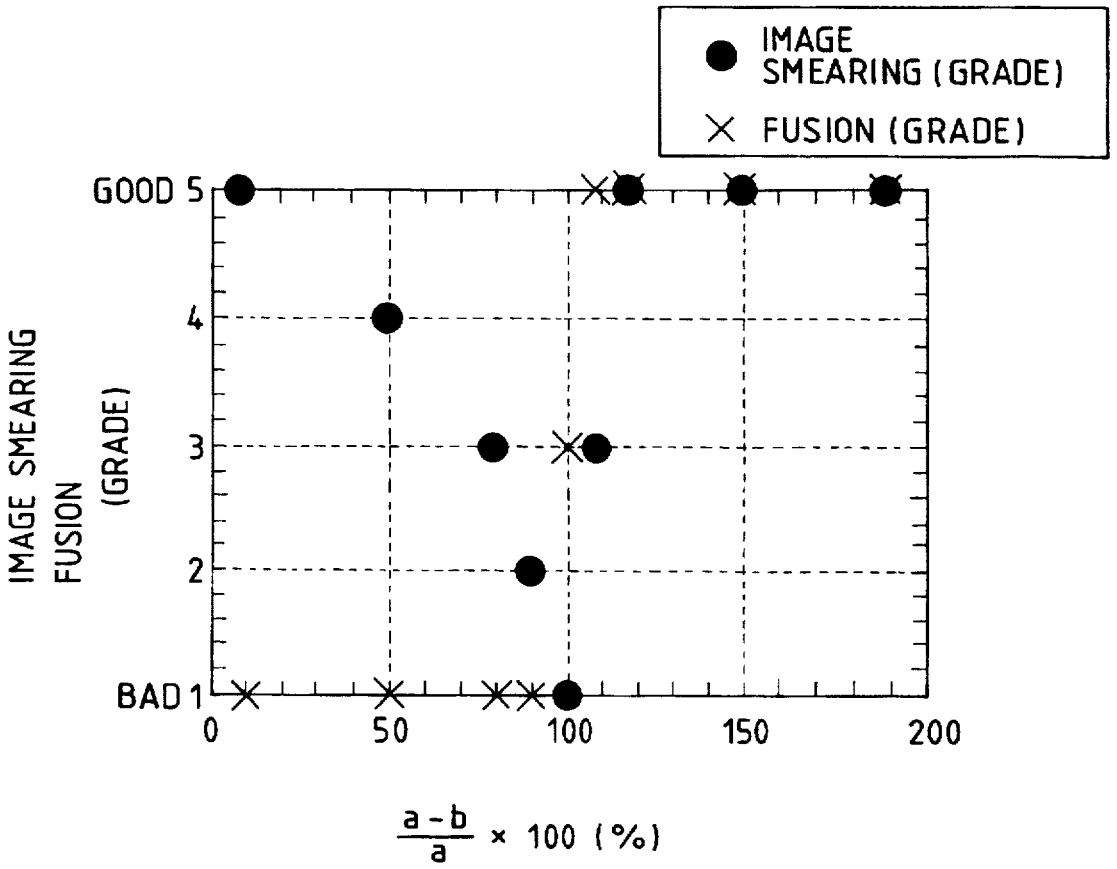
FIG. 11 is a graph showing an example of the dependency of the image smearing and fusion on the relative speed of the charging member to the photosensitive member in the present invention.

The same apparatus was used as in Experiment Example 4. The rotation speed of the contact type charging member was changed relative to that of the charging object to change the speed ratio at the opposing position (hereinafter referred to as "relative speed"). Thereby occurrence of image smearing, and fusion was investigated. FIG. 11 shows the results.

As shown in FIG. 11, the charging member and the charging object are preferably rotated such that the opposing surfaces are moved in a reverse direction. The ratio of $|(a-b)/a|\times100\%$ is preferably not lower than 110%, where the movement direction of the charging object surface is positive, and a is the movement speed of the charging object surface and b is the movement speed of the charging member surface.

EXPERIMENT EXAMPLE 6

The same apparatus was used as in Experiment Example 4 except that various photosensitive members were employed. The photosensitive members were evaluated for temperature characteristics, photomemory, image smearing, and unevenness of the density of the half tone image (hereinafter referred to as "image coarseness").

The photosensitive members comprising a charge injection-inhibiting layer, a photoconductive layer, and a surface layer were prepared on mirror-polished aluminum cylinders of 108 mm diameter under the conditions shown in Table 1 by means of an RF-PCVD apparatus shown in FIG. 5 for producing a photosensitive member for image-forming apparatus. Various photosensitive members were prepared with the photosensitive layers formed by changing the $SiH_4$—$H_2$ mixing ratio and the discharge power.

The temperature characteristics were evaluated by the change of the chargeability of the photosensitive member in the temperature range of from room temperature to about 45° C. The photosensitive member exhibiting the chargeability change rate of not higher than 2 V/° C. is evaluated to be acceptable.

The photomemory, the image smearing, and the image coarseness were evaluated by visual examination of the formed image, and were rated on five grades of 5 (excellent), 4 (good), 3 (no problem practically), 2 (slightly defective in practical use), and 1 (useless practically).

Separately, an a-Si film of about 1 μm thick was deposited under the same conditions as the photosensitive layer respectively onto a glass substrate (Corning Co., 7059) and an Si wafer which had been fixed on a cylindrical sample holder. On the deposited film on the glass substrate, a comb type aluminum electrode was vapor-deposited, and the characteristic energy (Eu) of the exponential tail, and density of state (DOS) of the deposition film was measured by CPM. The deposited film on the Si wafer was subjected to measurement of the hydrogen content, and the absorption peak intensity ratio of Si—$H_2$ bond to Si—H bond by FTIR.

Figure 12:
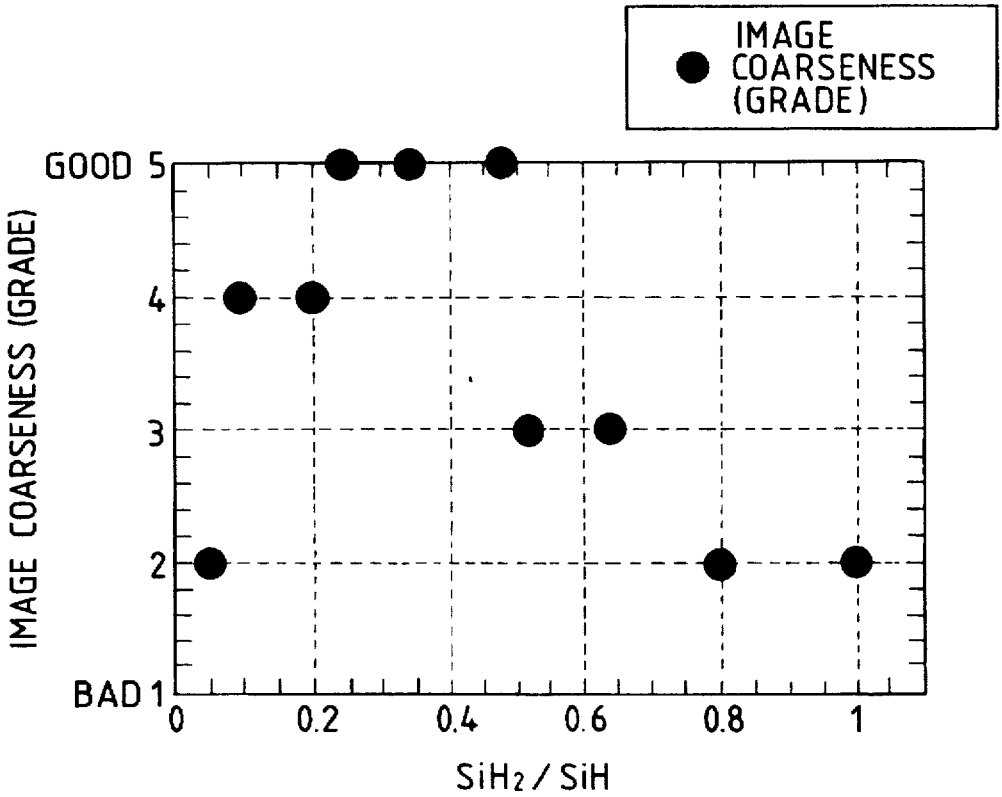
FIG. 12 is a graph showing an example of the dependency of the half tone density unevenness (coarseness) on the ratio of the absorption peak intensity of Si—$H_2$ bonding to that of Si—H bonding of the photoconductive layer of the photosensitive member for an image-forming apparatus of the present invention.
Figure 13:
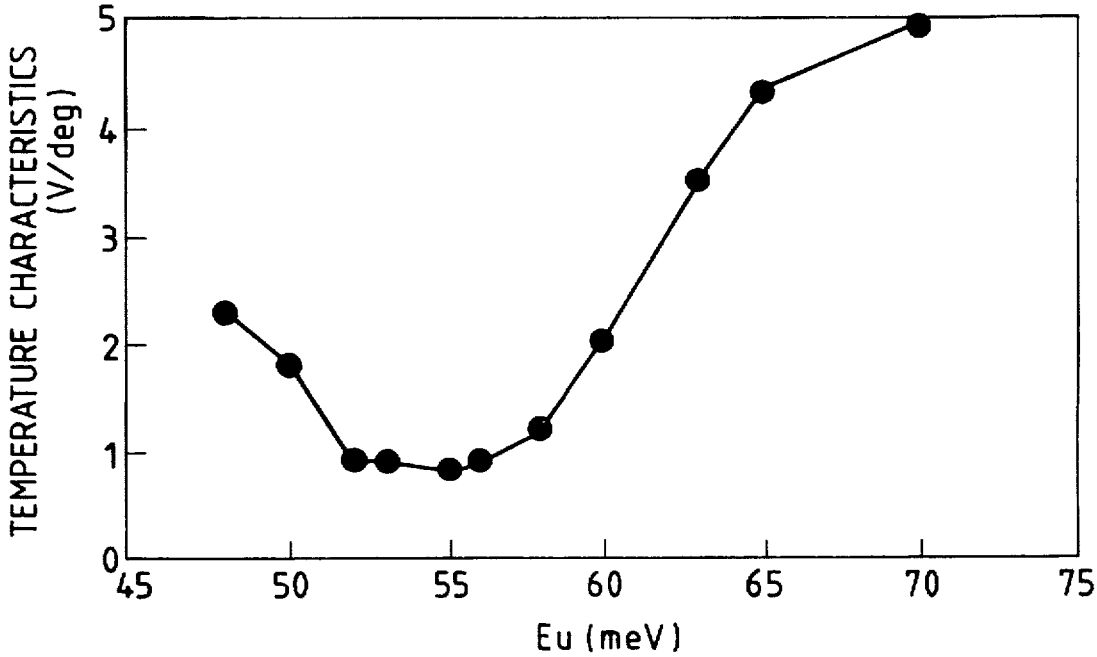
FIG. 13 is a graph showing an example of the dependency of the temperature characteristics of the photoconductive layer on the characteristic energy (Eu) of Urbuck tail in the photosensitive member for the image-forming apparatus of the present invention.
Figure 14:
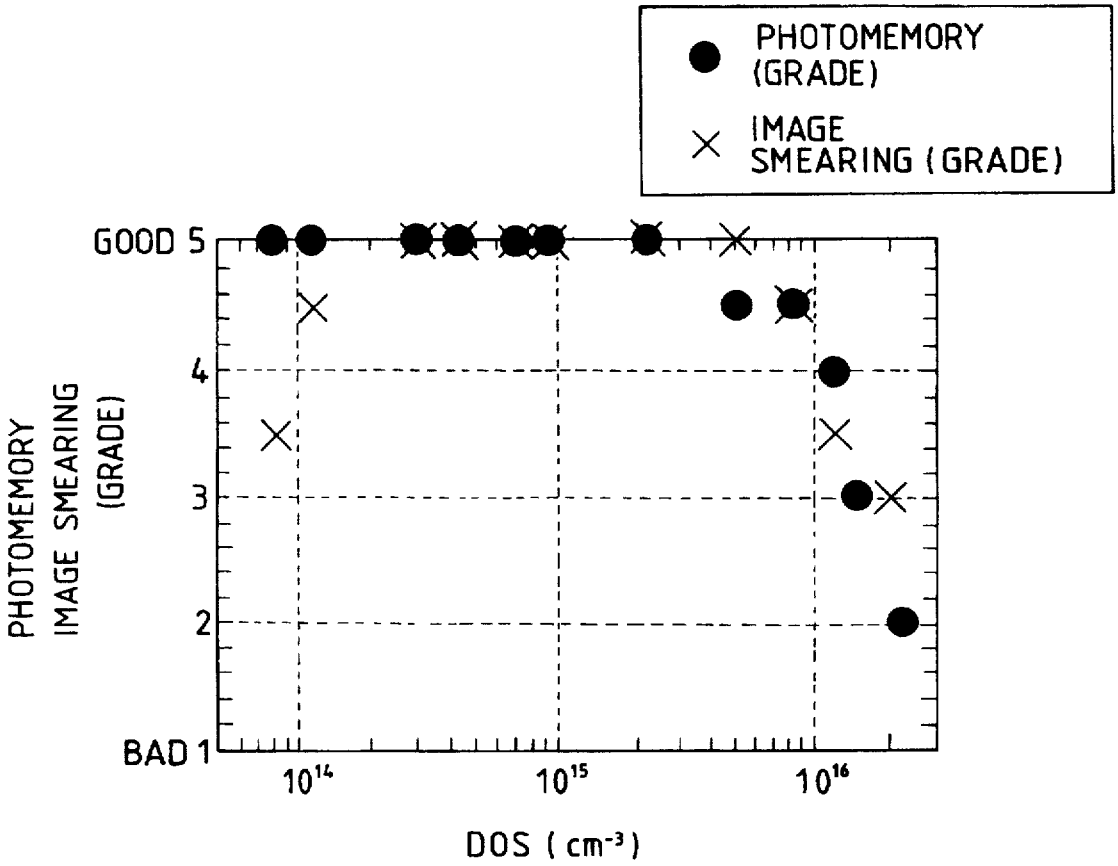
FIG. 14 is a graph showing an example of the dependency of the photomemory and the image smearing on density of state (DOS) of the photoconductive layer for an image-forming apparatus of the present invention.

FIG. 12 shows the dependence of the coarseness on the ratio of Si—$H_2$/Si—H. FIG. 13 shows the dependence of the temperature characteristics on Eu. FIG. 14 shows the dependence of the photomemory and the image smearing on DOS. The hydrogen content of the samples were respectively within the range of from 10 to 30 atomic %.

As shown in FIGS. 12, 13, and 14, the image coarseness was improved in the Si—$H_2$/Si—H ratio range of from 0.2 to 0.5, and the temperature characteristics, the photomemory, and the image smearing were improved by bringing the density of state into the range of from $1\times10^{14}$ to $1\times10^{16}$ $cm^{-3}$ and the characteristic energy of exponential tail into the range of from 50 to 60 meV as measured by subband gap light absorption spectrum at least at the light introduction portion.

A sample of the surface layer was prepared in the same manner as above, and the resistivity was measured by employing a comb type electrode. The surface layer has resistivity ranging preferably from $1\times10^{10}$ to $5\times10$ Ωcm, more preferably from $1\times10^{10}$ to $1\times10^{15}$ Ωcm, and still more preferably from $1\times10^{12}$ to $1\times10^{14}$ Ωcm. In order to maintain the electrical properties such as charge retention ability and charging efficiency and to prevent surface damage by voltage or pinhole leakage the surface layer resistivity is preferably between the aforesaid ranges. The resistivity was measured by a MΩ tester of HIOKI Co. at application voltage of from 250 V to 1 kV.

The effects of the present invention are explained in more detail by reference to Examples without limiting the invention thereby.

EXAMPLE 1

A image-forming apparatus was used which employs the contact type charging system as shown in FIGS. 2A and 2B. The photosensitive drum 101 for bearing an image was rotated in a clockwise direction as shown in the arrow mark at a predetermined peripheral speed (process speed). A heater was provided inside the drum to heat the photosensitive member. The photosensitive member was kept at a temperature of 45° C.

A contact type charging member 202 was constituted of a multipolar magnetic body 202-2 and a brush layer 202-1 formed thereon from the aforementioned charging carrier. The surface of the multipolar magnetic body 202-2 was covered with a magnetopermeable electroconductive aluminum tape (3M Co., Electrical Tape 1181) so that the applied voltage could be sufficiently applied to the entire part of the brush layer.

The brush layer 202-1 was constituted of magnetic ferrite as mentioned before. Several brush layers were prepared which had different resistivity in the range of from $1\times10^{3}$ to $1\times10^{12}$ Ωcm as measured by a MΩ Tester (HIOKI Co.) by application of 500 V to 1 kV.

The minimum distance between the photosensitive drum 101 and the contact type charging member 202 was kept stably by a spacer (not shown in the drawing) in the range of from 100 to 1000 μm for controlling the nip.

A voltage source 203 applies DC voltage Vdc to the brush layer 202-1 constituted of a charging carrier of the charging member to charge uniformly the outer peripheral surface of the rotating photosensitive drum 101. In this Example, Vdc was adjusted to 800 V.

An electrostatic latent image is formed on the photosensitive drum by irradiation of the image-forming light 105. This latent image is developed by a development sleeve 106 coated with a developing agent, and is then transferred by a transfer roller 108 onto an image-receiving medium 107. The remaining toner after the image transfer is subjected to rubbing with a cleaning mag roller (not shown in the drawing) employing a magnetic brush, and then the toner still remaining on the surface of the photosensitive drum is removed by a cleaning blade 109 from the photosensitive drum. The transferred image is fixed by a fixing system not shown in the drawing, and sent out of the apparatus.

On the other hand, photosensitive members comprising a charge injection-inhibiting layer, a photoconductive layer, and a surface layer were prepared on mirror-polished aluminum cylinders of 108 mm diameter under the conditions shown in Table 1 by means of an RF-PCVD apparatus for producing a photosensitive member for image-forming apparatus as shown in FIG. 5. Various photosensitive members were prepared with the photosensitive layers formed by changing the $SiH_4$—$H_2$ mixing ratio and the discharge power. Further, various photosensitive members were prepared by changing the resistivity of the surface layer.

Separately, an a-Si film of about 1 μm thick was deposited under the same conditions as the photosensitive layer respectively onto a glass substrate (Corning Co., 7059) and an Si wafer which had been fixed on a cylindrical sample holder. On the deposited film on the glass substrate, a comb type aluminum electrode was vapor-deposited, and the characteristic energy (Eu) of the exponential tail, and density of state (DOS) of the deposited film was measured by CPM. The deposited film on the Si wafer was subjected to FTIR measurement of the hydrogen content.

Further, samples of the surface layer were prepared, and the resistivities thereof were measured with a comb type electrode.

The prepared photosensitive member and the charging member were set in the aforementioned image-forming apparatus shown in FIGS. 2A and 2B. The charging member was rotated in a surface movement direction reverse to the rotational movement of the photosensitive member at the opposing surface at a surface movement speed ratio of 0.1 to the photosensitive member. The process speed was changed with the photosensitive member kept heated, thereby changing the charging time. The chargeability, the temperature characteristics and the photomemory of the photosensitive member and the image smearing, the image coarseness, and other image qualities were evaluated. Table 2 shows the results.

The chargeability was evaluated by measuring the potential immediately after the charging, and deriving the ratio of the potential immediately after the charging to the applied voltage (charging efficiency). The chargeability of 90% was evaluated as being acceptable.

The temperature characteristics were evaluated by the change of the chargeability of the photosensitive member in the temperature range of from room temperature to about 45° C. The photosensitive member exhibiting the chargeability change rate of not higher than 2 V/°C. is evaluated to be acceptable.

The photomemory, the image smearing, and the image coarseness were evaluated by visual examination of the formed image, and were rated on five ranks of 5 (excellent), 4 (good), 3 (no problem practically), 2 (slightly defective in practical use), and 1 (useless practically).

As shown in Table 2, sufficient chargeability, satisfactory temperature characteristics, desirable photomemory, and excellent image quality without image smearing or coarseness were obtained when the resistivity of the charging member was in the range of from $1\times10^4$ to $1\times10^9$ Ωcm; the particle diameter of the magnetic powder was in the range of from 10 to 50 μm; the charging time was not less than 10 msec; the photoconductive layer had Eu ranging from 50 to 60 meV, DOS ranging from $1\times10^{14}$ to $1\times10^{16}$ $cm^{-3}$, and the ratio Si—$H_2$/SiH ranging from 0.2 to 0.5; and the resistivity of the surface layer was in the range of from $1\times10^{10}$ to $1\times10^{15}$ Ωcm. Thus an image-forming apparatus could be obtained which is capable of forming high-quality images as a whole.

EXAMPLE 2

The image-forming apparatus employing contact type charging system as in Example 1 used was the same as the one used in Example 1. The image formation was conducted with several photosensitive members as in Example 1, and charging carriers having several particle diameters as in Example 1 were used, and the speed of the charging member relative to the photosensitive member (relative speed) was changed.

The resistivity of the magnetic brush was $1\times10^6$ Ωcm. The magnetic force of the multipolar magnetic body was 1000 G. The charging time was 50 msec. The pre-exposure was not conducted. The rubbing device having cleaning mag roller employing a magnetic brush was removed. The photosensitive member was not heated. Thus the image smearing, the fusion, and the image stability were evaluated. FIGS. 3A and 3B shows the results.

The image smearing, the fusion, and the image stability were evaluated by visual examination of the formed image, and were rated on five ranks: 5 (excellent), 4 (good), 3 (no problem practically), 2 (slightly defective in practical use), and 1 (useless practically).

As shown in Table 3, even under the conditions of no pre-exposure, no rubbing step by cleaning mag roller or the like, and no heating of the photosensitive member, excellent image quality could be achieved without smearing or coarseness of the images with high image stability. This could be achieved when the particle diameter of the magnetic powder was in the range of from 10 to 50 μm, the charging member was rotated in a surface movement direction reverse to the photosensitive member at the opposing surface at a surface movement speed of not less than 0.1, the photoconductive layer had Eu in the range of from 50 to 60 meV, DOS in the range of from $1\times10^{14}$ to $1\times10^{16}$ $cm^{-3}$, and the Si—$H_2$/Si—H ratio in the range of from 0.2 to 0.5, and the resistivity of the surface layer was in the range of from $1\times10^{10}$ to $1\times10^{15}$ Ωcm. Thus an image-forming apparatus could be obtained which is capable of forming high-quality images as a whole.

EXAMPLE 3

Photosensitive members comprising a charge injection-inhibiting layer, a photoconductive layer, and a surface layer were prepared on the same mirror-polished aluminum cylinders (supports) as used in Example 1 under the conditions shown in Table 4 by means of a VHF-PCVD apparatus for producing a photosensitive member for image-forming apparatus as shown in FIG. 6.

Further, various photosensitive members were prepared with the photosensitive layers formed by changing the $SiH_4/H_2$ mixing ratio, the discharge power, the support temperature, and the internal pressure. Further, various photosensitive members were prepared by changing the resistivity of the surface layer.

Separately, an a-Si film of about 1 μm thick was deposited under the same conditions as the photosensitive layer respectively onto a glass substrate (Corning Co., 7059) and an Si wafer which had been fixed on a cylindrical sample holder. On the deposited film on the glass substrate, a comb type aluminum electrode was vapor-deposited, and the characteristic energy (Eu) of the exponential function tail, and density of state (DOS) of the deposited film was measured by CPM. The deposited film on the Si wafer was subjected to FTIR measurement of the hydrogen content.

Further, samples of the surface layer were prepared in the same manner, and the resistivities thereof were measured with a comb type electrode.

The prepared photosensitive member and the charging member were set in the same image-forming apparatus as that used in Example 1. The charging member was rotated in a surface movement direction reverse to the rotational movement of the photosensitive member at the opposing surface at a surface movement speed ratio of 0.1 to the photosensitive member. The process speed was changed with the photosensitive member kept heated, thereby changing the charging time. The chargeability, the temperature characteristics and the photomemory of the photosensitive member and the image qualities including the image smearing and the image coarseness were evaluated. Table 5 shows the results.

The chargeability, the temperature characteristics, and the photomemory of the photosensitive member, and the image qualities were evaluated in the same manner as in Example 1.

As shown in Table 5, sufficient chargeability, satisfactory temperature characteristics, desirable photomemory, and excellent image quality without smearing or coarseness of image were obtained when the resistivity of the charging member was in the range of from $1\times10^4$ to $1\times10^9$ Ωcm; the particle diameter of the magnetic powder was in the range of from 10 to 50 μm; the charging time was not less than 10 msec; the photoconductive layer had Eu ranging from 50 to 60 meV, DOS ranging from $1\times10^{14}$ to $1\times10^{16}$ $cm^{-3}$, and the ratio Si—$H_2$/Si—H ranging from 0.2 to 0.5; and the resistivity of the surface layer was in the range of from $1\times10^{10}$ to $1\times10^{15}$ Ωcm. Thus an image-forming apparatus could be obtained which is capable of forming high-quality images as a whole.

COMPARATIVE EXAMPLE 1

The same experiments were conducted as in Example 1 and Example 3 except that the resistivity of the charging member was outside the range of from $1\times10^4$ to $1\times10^9$ Ωcm; the particle diameter of the magnetic powder was outside the range of from 10 to 50 μm; the charging time was not less than 10 msec; the photoconductive layer had Eu outside the range of from 50 to 60 meV, DOS outside the range from $1\times10^{14}$ to $1\times10^{16}$ $cm^{-3}$, and the ratio Si—$H_2$/Si—H outside the range of from 0.2 to 0.5; and the resistivity of the surface layer was outside the range of from $1\times10^{10}$ to $1\times10^{15}$ Ωcm.

The results are shown in Table 2 and Table 5. Satisfactory properties could not be obtained totally.

COMPARATIVE EXAMPLE 2

The experiments were conducted as in Example 2 except that the particle diameter of the magnetic powder was outside the range of from 10 to 50 μm; the charging member was rotated in a surface movement direction reverse to the rotational movement of the photosensitive member at the opposing surface at a surface movement speed ratio of less than 0.1 to the photosensitive member; the photoconductive layer had Eu outside the range of from 50 to 60 meV, DOS outside the range from $1\times10^{14}$ to $1\times10^{16}$ $cm^{-3}$, and the ratio Si—$H_2$/Si—H outside the range of from 0.2 to 0.5; and the resistivity of the surface layer was outside the range of from $1\times10^{10}$ to $1\times10^{15}$ Ωcm.

The results are shown in Table 3. The high quality of images could not be achieved as a whole under the conditions of no pre-exposure, no rubbing by a cleaning mag roller or the like, and no heating of the photosensitive member.

As described above, the present invention provides an image-forming apparatus which employs a contact type charging member having an optimum resistance of the magnetic brush, an optimum particle diameter of the carrier, an optimum magnetic force of the multipolar magnetic body, an optimum charging time at the contacting portion of the photosensitive member, and optimum relative surface speed of the charging member and the photosensitive member. Thereby, the image-forming apparatus gives excellent images without humidity-smearing of the images by employing an ozoneless charging device.

More specifically, firstly, the charging object employed in the present invention is a photosensitive member which is comprised of an electroconductive support and a light-receiving layer comprising a photoconductive layer constituted of a non-single-crystal material containing silicon atoms as a matrix and hydrogen and/or halogen atoms and being photoconductive, and a surface layer having a function of retaining charges, wherein the photoconductive layer contains hydrogen at a content ranging from 10 to 30 atomic %, having density of state ranging from $1\times10^{14}$ to $1\times10^{16}$ $cm^{-3}$ and characteristic energy of the exponential tail ranging from 50 to 60 meV, derived from subband-gap light absorption spectrum at least at a light-introducing portion, thereby the photomemory inherent to the amorphous silicon photosensitive member being reduced, and the temperature dependence of electric properties being reduced to enabling omission of temperature control of the photosensitive member. Further, the resistivity of the surface layer has $1\times10^{10}$ to $1\times10^{15}$ Ωcm, the multipolar magnetic body has a magnetic force of not lower than 500 G; the magnetic powder has a resistivity ranging from $1\times10^{4}$ to $1\times10^{9}$ ncm, and particle diameters ranging from 10 to 50 μm; the time of contact of a point on the charging object with the charging member is not shorter than 10 msec; thereby, a high charging efficiency being achieved and sufficient levelling effect being attained, which enables omission of the charge-removing light exposure or enables sufficient charging even with strong charge-removing light exposure in combination of the above photoconductive layer, and the photomemory is reduced without lowering of the chargeability.

Secondary the charging member is moved in a surface movement direction reverse to the rotational movement of the charging object at the opposing surface at a surface movement speed ratio of not less than 0.1 to the charging object, and the particle diameters of the magnetic powder are selected in the range of from 10 to 50 μm, thereby enabling omission of the operation of rubbing with a cleaner employing a magnetic brush or the like for prevention of high-humidity image smearing.

Accordingly, the combination of the novel photosensitive member having improved temperature characteristics and improved electrical properties with an ozoneless charger reduces or eliminates the photomemory without impairing the chargeability, and further enables energy saving and miniaturization of the apparatus with retention of high image quality without high-humidity image smearing.

TABLE 1

| | Charge injection inhibiting layer | Photo-conductive layer | Surface layer |
|---|---|---|---|
| Gas and flow rate | | | |
| $SiH_4$ (SCCM) | 100 | 200 | 10 |
| $H_2$ (SCCM) | 300 | 800 | |
| $B_2H_6$ (ppm, based on $SiH_4$) | 2000 | 2 | |
| NO (SCCM) | 50 | | |
| $CH_4$ (SCCM) | | | 500 |
| Support temperature (°C.) | 290 | 290 | 290 |
| Internal pressure (Torr) | 0.5 | 0.5 | 0.5 |
| Power (W) | 500 | 800 | 300 |
| Layer thickness (μm) | 3 | 30 | 0.5 |

TABLE 2

| Photosensitive drum | | | | | | | | | Evaluation* | | | | | |
|---|---|---|---|---|---|---|---|---|---|---|---|---|---|---|
| Eu (meV) | DOS ($cm^{-3}$) | $SiH_2$ /SiH | Surface layer resistivity (Ωcm) | Brush resistivity (Ωcm) | Particle diameter (μ) | Magnetic force (G) | Charging time (msec) | Pre-exposure | Chargeability | Temperature characteristic | Memory | Image smearing | Image quality | Overall |
| 40 | $1\times10^{15}$ | 0.4 | $1\times10^{14}$ | $1\times10^{6}$ | 30 | 1000 | 50 | none | (4) | (2) | (4) | (4) | (4) | (3) |
| 55 | $1\times10^{16}$ | 0.4 | $1\times10^{14}$ | $1\times10^{6}$ | 30 | 1000 | 50 | none | (5) | (4) | (4) | (4) | (4) | (5) |
| 70 | $1\times10^{15}$ | 0.4 | $1\times10^{14}$ | $1\times10^{6}$ | 30 | 1000 | 50 | none | (4) | (2) | (3) | (4) | (4) | (3) |
| 55 | $1\times10^{13}$ | 0.4 | $1\times10^{14}$ | $1\times10^{6}$ | 30 | 1000 | 50 | none | (4) | (4) | (4) | (2) | (3) | (3) |
| 55 | $1\times10^{17}$ | 0.4 | $1\times10^{14}$ | $1\times10^{6}$ | 30 | 1000 | 50 | none | (4) | (3) | (2) | (2) | (3) | (2) |
| 55 | $1\times10^{15}$ | 0.8 | $1\times10^{14}$ | $1\times10^{6}$ | 30 | 1000 | 50 | none | (4) | (3) | (3) | (4) | (2) | (3) |
| 55 | $1\times10^{15}$ | 0.4 | $1\times10^{8}$ | $1\times10^{6}$ | 30 | 1000 | 50 | none | (3) | (4) | (4) | (2) | (3) | (3) |
| 55 | $1\times10^{15}$ | 0.4 | $1\times10^{17}$ | $1\times10^{6}$ | 30 | 1000 | 50 | none | (3) | (4) | (4) | (3) | (4) | (4) |
| 55 | $1\times10^{15}$ | 0.4 | $1\times10^{14}$ | $1\times10^{3}$ | 30 | 1000 | 50 | none | (2) | (4) | (4) | (4) | (4) | (3) |
| 55 | $1\times10^{15}$ | 0.4 | $1\times10^{14}$ | $1\times10^{12}$ | 30 | 1000 | 50 | none | (2) | (4) | (4) | (4) | (4) | (3) |
| 55 | $1\times10^{15}$ | 0.4 | $1\times10^{14}$ | $1\times10^{6}$ | 5 | 1000 | 50 | none | (4) | (4) | (4) | (4) | (2) | (3) |
| 55 | $1\times10^{15}$ | 0.4 | $1\times10^{14}$ | $1\times10^{6}$ | 80 | 1000 | 50 | none | (4) | (4) | (4) | (4) | (2) | (3) |

TABLE 2-continued

| Photosensitive drum | | | | | | | | | Evaluation* | | | | | |
|---|---|---|---|---|---|---|---|---|---|---|---|---|---|---|
| Eu (meV) | DOS ($cm^{-3}$) | $SiH_2$ /SiH | Surface layer resistivity (Ωcm) | Brush resistivity (Ωcm) | Particle diameter (μ) | Magnetic force (G) | Charging time (msec) | Pre-exposure | Charge ability | Temperature characteristic | Memory | Image smearing | Image quality | Overall |
| 55 | $1 \times 10^{15}$ | 0.4 | $1 \times 10^{14}$ | $1 \times 10^{6}$ | 30 | 500 | 50 | none | (4) | (4) | (4) | (4) | (2) | (3) |
| 55 | $1 \times 10^{15}$ | 0.4 | $1 \times 10^{14}$ | $1 \times 10^{6}$ | 30 | 1000 | 1 | none | (2) | (4) | (2) | (4) | (4) | (2) |
| 55 | $1 \times 10^{15}$ | 0.4 | $1 \times 10^{14}$ | $1 \times 10^{6}$ | 30 | 1000 | 50 | Exposed | (2) | (4) | (4) | (4) | (4) | (3) |
| 55 | $1 \times 10^{15}$ | 0.4 | $1 \times 10^{14}$ | $1 \times 10^{6}$ | 30 | 1000 | 100 | Exposed | (3) | (4) | (5) | (4) | (4) | (5) |

*Evaluation grades: (5) Excellent, (4) Good, (3) No problem practically, (4) Slightly defective practically, (5) Useless practically

TABLE 3

| Photosensitive drum | | | | | | Evaluation* | | | |
|---|---|---|---|---|---|---|---|---|---|
| Eu (meV) | DOS ($cm^{-3}$) | $SiH_2$ /SiH | Surface layer resistivity (Ωcm) | Particle diameter (μ) | Relative speed | Image smearing | Fusion | Image stability | Overall |
| 40 | $1 \times 10^{15}$ | 0.4 | $1 \times 10^{14}$ | 30 | 110 | (3) | (3) | (2) | (2) |
| 55 | $1 \times 10^{15}$ | 0.4 | $1 \times 10^{14}$ | 30 | 110 | (3) | (3) | (4) | (4) |
| 70 | $1 \times 10^{15}$ | 0.4 | $1 \times 10^{14}$ | 30 | 110 | (3) | (3) | (2) | (2) |
| 55 | $1 \times 10^{13}$ | 0.4 | $1 \times 10^{14}$ | 30 | 110 | (1) | (3) | (4) | (2) |
| 55 | $1 \times 10^{17}$ | 0.4 | $1 \times 10^{14}$ | 30 | 110 | (1) | (3) | (3) | (1) |
| 55 | $1 \times 10^{15}$ | 0.8 | $1 \times 10^{14}$ | 30 | 110 | (3) | (3) | (3) | (3) |
| 55 | $1 \times 10^{15}$ | 0.4 | $1 \times 10^{8}$ | 30 | 110 | (1) | (3) | (4) | (2) |
| 55 | $1 \times 10^{15}$ | 0.4 | $1 \times 10^{17}$ | 30 | 110 | (2) | (3) | (4) | (2) |
| 55 | $1 \times 10^{15}$ | 0.4 | $1 \times 10^{14}$ | 5 | 110 | (1) | (3) | (4) | (2) |
| 55 | $1 \times 10^{15}$ | 0.4 | $1 \times 10^{14}$ | 5 | 110 | (3) | (3) | (4) | (4) |
| 55 | $1 \times 10^{15}$ | 0.4 | $1 \times 10^{14}$ | 200 | 110 | (1) | (3) | (4) | (2) |
| 55 | $1 \times 10^{15}$ | 0.4 | $1 \times 10^{14}$ | 30 | 150 | (5) | (4) | (4) | (5) |
| 55 | $1 \times 10^{15}$ | 0.4 | $1 \times 10^{14}$ | 30 | 50 | (4) | (2) | (4) | (3) |

*Evaluation grades: (5) Excellent, (4) Good, (3) No problem practically, (4) Slightiy defective practically, (5) Useless practically

TABLE 4

| | Charge injection inhibiting layer | Photoconductive layer | Surface layer |
|---|---|---|---|
| Gas and flow rate | | | |
| $SiH_4$ (SCCM) | 150 | 200 | 200→10 |
| $SiF_4$ (SCCM) | 5 | 3 | 10 |
| $H_2$ (SCCM) | 500 | 800 | |
| $B_2H_6$ (ppm, based on $SiH_4$) | 1500 | 3 | |
| NO (SCCM) | 10 | | |

TABLE 4-continued

| | Charge injection inhibiting layer | Photoconductive layer | Surface layer |
|---|---|---|---|
| $CH_4$ (SCCM) | 5 | | 0→500 |
| Support temperature (°C.) | 300 | 300 | 300 |
| Internal pressure (mTorr) | 30 | 10 | 20 |
| Power (W) | 200 | 600 | 100 |
| Layer thickness (μm) | 2 | 30 | 0.5 |

TABLE 5

| Photosensitive drum | | | | | | | | | Evaluation* | | | | | |
|---|---|---|---|---|---|---|---|---|---|---|---|---|---|---|
| Eu (meV) | DOS ($cm^{-3}$) | $SiH_2$ /SiH | Surface layer resistivity (Ωcm) | Brush resistivity (Ωcm) | Particle diameter (μ) | Magnetic force (G) | Charging time (msec) | Pre-exposure | Charge ability | Temperature characteristic | Memory | Image smearing | Image quality | Overall |
| 40 | $1 \times 10^{15}$ | 0.3 | $1 \times 10^{14}$ | $1 \times 10^{6}$ | 30 | 1000 | 50 | none | (4) | (2) | (4) | (4) | (4) | (3) |

TABLE 5-continued

| Photosensitive drum | | | | | | | | | Evaluation* | | | | | |
|---|---|---|---|---|---|---|---|---|---|---|---|---|---|---|
| Eu (meV) | DOS ($cm^{-3}$) | $SiH_2$ /SiH | Surface layer resistivity (Ωcm) | Brush resistivity (Ωcm) | Particle diameter (μ) | Magnetic force (G) | Charging time (msec) | Pre-exposure | Chargeability | Temperature characteristic | Memory | Image smearing | Image quality | Overall |
| 55 | $1 \times 10^{15}$ | 0.3 | $1 \times 10^{14}$ | $1 \times 10^{6}$ | 30 | 1000 | 50 | none | (5) | (4) | (4) | (4) | (4) | (5) |
| 70 | $1 \times 10^{15}$ | 0.3 | $1 \times 10^{14}$ | $1 \times 10^{6}$ | 30 | 1000 | 50 | none | (4) | (2) | (3) | (4) | (4) | (3) |
| 55 | $1 \times 10^{13}$ | 0.3 | $1 \times 10^{14}$ | $1 \times 10^{6}$ | 30 | 1000 | 50 | none | (4) | (4) | (4) | (2) | (3) | (3) |
| 55 | $1 \times 10^{17}$ | 0.3 | $1 \times 10^{14}$ | $1 \times 10^{6}$ | 30 | 1000 | 50 | none | (4) | (3) | (2) | (2) | (3) | (2) |
| 55 | $1 \times 10^{15}$ | 0.8 | $1 \times 10^{14}$ | $1 \times 10^{6}$ | 30 | 1000 | 50 | none | (4) | (3) | (3) | (4) | (2) | (3) |
| 55 | $1 \times 10^{15}$ | 0.3 | $1 \times 10^{8}$ | $1 \times 10^{6}$ | 30 | 1000 | 50 | none | (3) | (4) | (4) | (2) | (3) | (3) |
| 55 | $1 \times 10^{15}$ | 0.3 | $1 \times 10^{17}$ | $1 \times 10^{6}$ | 30 | 1000 | 50 | none | (3) | (4) | (4) | (3) | (4) | (4) |
| 55 | $1 \times 10^{15}$ | 0.3 | $1 \times 10^{14}$ | $1 \times 10^{3}$ | 30 | 1000 | 50 | none | (2) | (4) | (4) | (4) | (4) | (3) |
| 55 | $1 \times 10^{15}$ | 0.3 | $1 \times 10^{14}$ | $1 \times 10^{11}$ | 30 | 1000 | 50 | none | (2) | (4) | (4) | (4) | (4) | (3) |
| 55 | $1 \times 10^{15}$ | 0.3 | $1 \times 10^{14}$ | $1 \times 10^{6}$ | 5 | 1000 | 50 | none | (4) | (4) | (4) | (4) | (2) | (3) |
| 55 | $1 \times 10^{15}$ | 0.3 | $1 \times 10^{14}$ | $1 \times 10^{6}$ | 80 | 1000 | 50 | none | (4) | (4) | (4) | (4) | (2) | (3) |
| 55 | $1 \times 10^{15}$ | 0.3 | $1 \times 10^{14}$ | $1 \times 10^{6}$ | 30 | 500 | 50 | none | (4) | (4) | (4) | (4) | (2) | (3) |
| 55 | $1 \times 10^{15}$ | 0.3 | $1 \times 10^{14}$ | $1 \times 10^{6}$ | 30 | 1000 | 1 | none | (2) | (4) | (2) | (4) | (4) | (2) |
| 55 | $1 \times 10^{15}$ | 0.3 | $1 \times 10^{14}$ | $1 \times 10^{6}$ | 30 | 1000 | 50 | Exposed | (2) | (4) | (4) | (4) | (4) | (3) |
| 55 | $1 \times 10^{15}$ | 0.3 | $1 \times 10^{14}$ | $1 \times 10^{6}$ | 30 | 1000 | 100 | Exposed | (3) | (4) | (5) | (4) | (4) | (5) |

*Evaluation grades: (5) Excellent, (4) Good, (3) No problem practically, (4) Slightly defective practically, (5) Useless practically

What is claimed is:

1. An image-forming apparatus for forming an electrostatic latent image on a surface of a charging object by applying a voltage to a charging member comprising a cylindrical multipolar magnetic body and a brush layer formed from a magnetic powder on the peripheral surface of the multipolar magnetic body, and charging the surface of the charging object by rubbing the surface thereof with the surface of the brush layer by movement in a reverse direction, and forming an electrostatic latent image on the surface of the charging object, wherein the charging object is a photosensitive member having a photoconductive layer comprising a non-single-crystal material containing silicon atoms as a matrix and hydrogen and/or halogen atoms on an electroconductive support; the photoconductive layer contains hydrogen at a content ranging from 10 to 30 atomic %, and Si—$H_2$/Si—H at a ratio ranging from 0.2 to 0.5, having density of state ranging from $1\times10^{14}$ $cm^{-3}$ to $1\times10^{16}$ $cm^{-3}$ and characteristic energy of the exponential tail ranging from 50 to 60 meV derived from subband-gap light absorption spectrum at least at a light introducing portion, and having a surface resistivity ranging from $1\times10^{10}$ to $5\times10^{15}$ Ωcm; the multipolar magnetic body has a magnetic force of not lower than 500 G; the magnetic powder has a resistivity ranging from $1\times10^{4}$ to $1\times10^{9}$ Ωcm and particle diameters ranging from 10 to 50 μm; the time of contact of a point on the charging object with the brush layer is not shorter than 10 msec; and the charging member and the charging object move at a relative moving speed in relation of (a–b)/a×100% of not less than 110% where a is the moving speed of the charging object, b is the moving speed of the charging member, and the rotation direction of the charging object is taken to be positive.

2. The image-forming apparatus according to claim 1, wherein the apparatus has an optical charge-removing means for removing the electric charge from the charging object.

3. The image-forming apparatus according to claim 1, wherein the photosensitive member has a surface layer.

4. The image-forming apparatus according to claim 1, wherein the photosensitive member has a charge injection-inhibiting layer.

5. The image-forming apparatus according to claim 1, wherein the photosensitive member has a charge injection-inhibiting layer at the support side of the photoconductive layer, and a surface layer at the side opposite to the support.

6. The image-forming apparatus according to claim 1, wherein the charging member has a member for controlling the thickness of the magnetic brush.

7. The image-forming apparatus according to claim 1, wherein a spacer is provided for controlling the gap between the charging member and the charging object.

8. The image-forming apparatus according to claim 1, wherein the magnetic force is not less than 1000 G.

9. The image-forming apparatus according to claim 1, wherein the surface resistivity ranges from $1\times10^{10}$ to $1\times10^{15}$ Ωcm.

10. An image-forming method for forming an electrostatic latent image on a surface of a charging object by applying a voltage to a charging member comprising a cylindrical multipolar magnetic body and a brush layer formed from a magnetic powder on the peripheral surface of the multipolar magnetic body, and charging the surface of the charging object by rubbing the surface thereof with the surface of the brush layer by movement in a reverse direction, and irradiating imagewise the surface of the charging object to form an electrostatic latent image thereon, wherein the charging object is a photosensitive member having a photoconductive layer comprising a non-single-crystal material containing silicon atoms as a matrix and hydrogen and/or halogen atoms on an electroconductive support; the photoconductive layer contains hydrogen at a content ranging from 10 to 30 atomic %, and Si—$H_2$/Si—H at a ratio ranging from 0.2 to 0.5, has density of state ranging from $1\times10^{14}$ $cm^{-3}$ to $1\times10^{16}$ $cm^{-3}$ and characteristic energy of the exponential tail ranging from 50 to 60 meV derived from subband-gap light absorption spectrum at least at a light introducing portion, and has a surface resistivity ranging from $1\times10^{10}$ to $5\times10^{15}$ Ωcm; the multipolar magnetic body has a magnetic force of not lower than 500 G; the magnetic powder has a resistivity ranging from $1\times10^{4}$ to $1\times10^{9}$ Ωcm and particle diameters ranging from 10 to 50 μm; the time of contact of a point on the charging object with the brush layer is not shorter than 10 msec; and the charging member and the charging object move at a relative moving speed in relation of $(a-b)/a\times100\%$ of not less than 110% where a is the moving speed of the charging object, b is the moving speed of the charging member, and the rotation direction of the charging object is taken to be positive.

* * * * *